US007531278B2

(12) United States Patent
Sugino et al.

(10) Patent No.: US 7,531,278 B2
(45) Date of Patent: May 12, 2009

(54) ELECTROSTATIC LATENT IMAGE BEARER, AND IMAGE FORMING METHOD, IMAGE FORMING APPARATUS AND PROCESS CARTRIDGE USING THE ELECTROSTATIC LATENT IMAGE BEARER

(75) Inventors: Akihiro Sugino, Numazu (JP); Takaai Ikegami, Susono (JP); Takeshi Takada, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 404 days.

(21) Appl. No.: 11/486,087

(22) Filed: Jul. 14, 2006

(65) Prior Publication Data

US 2007/0015074 A1 Jan. 18, 2007

(30) Foreign Application Priority Data

Jul. 14, 2005 (JP) ..... 2005-205874

(51) Int. Cl.
*G03G 5/147* (2006.01)

(52) U.S. Cl. ..... 430/66

(58) Field of Classification Search ..... 430/66
See application file for complete search history.

(56) References Cited

U.S. PATENT DOCUMENTS 6,360,069 B1 * 3/2002 Mimura et al. ..... 399/286
2006/0199092 A1 9/2006 Sugino et al.
2007/0015074 A1 1/2007 Sugino et al.

FOREIGN PATENT DOCUMENTS

| | | |
|---|---|---|
| JP | 09-124943 | 5/1997 |
| JP | 09-190004 | 7/1997 |
| JP | 2000-171990 | 6/2000 |
| JP | 06-118681 | 4/2004 |
| JP | 2004-117766 | 4/2004 |

OTHER PUBLICATIONS

U.S. Appl. No. 11/873,876, filed Oct. 17, 2007, Nakamori et al.
U.S. Appl. No. 11/876,396, filed Jan. 22, 2007, Nakamori et al.
U.S. Appl. No. 11/561,983, filed Nov. 21, 2006, Sugino et al.
U.S. Appl. No. 11/486,087, filed Jul. 14, 2006, Sugino et al.
U.S. Appl. No. 12/030,886, filed Feb. 14, 2008, Toda et al.
U.S. Appl. No. 11/695,750, filed Apr. 3, 2007, Takada et al.
U.S. Appl. No. 11/696,738, filed Apr. 5, 2007, Sugino.
U.S. Appl. No. 11/762,296, filed Jun. 13, 2007, Gondoh et al.

* cited by examiner

*Primary Examiner*—Hoa V Le
(74) *Attorney, Agent, or Firm*—Oblon, Spivak, McClelland, Maier & Neustadt, P.C.

(57) ABSTRACT

An electrostatic latent image bearer, comprising a substrate; a photosensitive layer overlying the substrate; and a protective layer overlying the photosensitive layer, wherein the protective layer includes a binder resin comprising a polyol, a polyisocyanate and an organic silicon compound having a hydroxyl or a hydrolyzable group.

32 Claims, 8 Drawing Sheets

ELECTROSTATIC LATENT IMAGE BEARER, AND IMAGE FORMING METHOD, IMAGE FORMING APPARATUS AND PROCESS CARTRIDGE USING THE ELECTROSTATIC LATENT IMAGE BEARER

BACKGROUND OF THE INVENTION

1. Field of the Invention

The present invention relates to an electrostatic latent image bearer (hereinafter referred to as an electrophotographic photoreceptor or a photoreceptor) for use in copiers, electrostatic printings, electrostatic recording, etc., and to an image forming method, an image forming apparatus and a process cartridge using the electrostatic latent image bearer.

2. Discussion of the Background

In image forming apparatuses such as a copier, a printer and a facsimile using an electrophotographic method, writing light modulated with image data is irradiated to a uniformly charged photoreceptor to form an electrostatic latent image thereon; and an image developer provides a toner to the electrostatic latent image to form a toner image thereon. After the image forming apparatus transfers the toner image onto a transfer sheet (recording paper) with a transferer, fixes the toner image on the transfer sheet upon application of heat and pressure with a fixer and collects the toner remaining on the photoreceptor with a cleaner such as a cleaning blade.

In such image forming apparatuses using electrophotographic methods, organic photoreceptors including organic photoconductive materials are most widely used. The organic photoreceptors have more advantages than other photoreceptors because materials in compliance with various irradiating light sources from visible light to infrared are easy to develop, materials free from environment pollution can be selected, the production cost thereof is low, etc. However, the organic photoreceptor has low mechanical strength and the photosensitive layer thereof is abraded after used for long periods. When the photosensitive layer is abraded in a specific amount, the electrical properties of the photoreceptor vary, resulting in occasional failure of proper image forming process. The photoreceptor is abraded in all parts contacting to other image forming units such as an image developer and a transferer.

Various suggestions are made to improve lives of photoreceptors by reducing the abrasion of photosensitive layers.

Japanese Patent No. 3258397 discloses a surface protective layer wherein a hardening silicone resin including colloidal silica is used. Although the abrasion resistance thereof is improved, foggy images and blurred images tend to be produced due to repeated use. In addition, the durability thereof is still insufficient for long-life photoreceptors recently required.

Japanese Patent No. 3640444 discloses polysiloxane positive-hole transport material formed by hardening silicon positive-hole transport material, which a silyl group having a hydrolyzable group is introduced to, and a polysiloxane resin as a protection material for the surface of a photoreceptor. Japanese Patent No. 3267519 discloses a photoreceptor having a surface layer including a resin formed by hardening a hardening organic silicon polymer and an organic silicon-modified positive-hole transport material.

However, blurred images tend to be produced and occurrence thereof needs to be prevented by a drum heater, etc., resulting in larger apparatus and higher costs thereof. In addition, the residual potential of irradiated parts thereof does not sufficiently decreases, resulting in deterioration of image density in a low-potential developing process controlling the charge potential.

Japanese Laid-Open Patent Publication No. 2000-171990 discloses a method of hardening a hardening siloxane resin having a charge transportability imparting group in the form of a three-dimensional network. The coated layer occasionally cracks due to the volume contraction, particularly with an inexpensive marketed coating agent easy to use. In addition, the residual potential of irradiated parts thereof depends on the layer thickness, resulting in deterioration of image density in a low-potential developing process. When the charge transportability imparting group is increased, the strength of the coated layer deteriorates, resulting occasional insufficient durability. Further, blurred images are occasionally produced.

Japanese Laid-Open Patent Publication No. 2000-171990 discloses a method of using a urethane resin in the protective layer of a photoreceptor to improve the abrasion resistance. However, although a urethane resin used in the protective layer considerably improves the abrasion resistance, the protective layer does not have sufficient adhesiveness to a binder resin, such as a polycarbonate resin, used in the photosensitive layer thereunder. Therefore, the protective layer occasionally peels therefrom at the end of a photoreceptor or because of a damage on the surface of the protective layer due to a carrier or a paper dust. At the part where the protective layer is peeled from the photosensitive layer, the photosensitive layer is exposed, and which has different chargeability and light transmittance, resulting in abnormal images such as unevenly colored images.

In addition, when the protective layer becomes thinner due to abrasion, the protective layer more easily peels and quickly disappears. When the thickness thereof is more thickened, the residual potential of the irradiated part increases, resulting in insufficient quality halftone images and low image density in negative-positive developing digital image forming apparatuses.

Further, recently, a spherical polymerized toner is put onto practical use due to requests for higher-quality images. However, the polymerized toner is known to typically be difficult to clean with a cleaning blade made of a urethane rubber. Therefore, the contact pressure is increased to improve the removability of the toner, but which not only accelerates the abrasion of a photoreceptor but also encourages the peeling of the protective layer. Accordingly, the image forming apparatus using the polymerized toner needs a photoreceptor which has a protective layer having higher abrasion resistance and no peeling.

Because of these reasons, a need exists for a highly-durable electrostatic latent image bearer having good electrophotographic image formability and capability of forming stable images for long periods in addition to high abrasion resistance and good adhesiveness of the protective layer to the photosensitive layer.

SUMMARY OF THE INVENTION

Accordingly, an object of the present invention is to provide a highly-durable electrostatic latent image bearer having good electrophotographic image formability and capability of forming stable images for long periods in addition to high abrasion resistance and good adhesiveness of the protective layer to the photosensitive layer.

Another object of the present invention is to provide an image forming apparatus using the electrostatic latent image bearer.

A further object of the present invention is to provide a process cartridge using the electrostatic latent image bearer.

Another object of the present invention is to provide an image forming method using the electrostatic latent image bearer, the image forming apparatus and the process cartridge.

These objects and other objects of the present invention, either individually or collectively, have been satisfied by the discovery of an electrostatic latent image bearer, comprising a substrate; a photosensitive layer, located overlying the substrate; and a protective layer, located overlying the photosensitive layer, wherein the protective layer includes a binder resin comprising polyol, polyisocyanate and an organic silicon compound having a hydroxyl or a hydrolyzable group.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention provides a highly-durable electrostatic latent image bearer having good electrophotographic image formability and capability of forming stable images for long periods in addition to high abrasion resistance and good adhesiveness of the protective layer to the photosensitive layer.

Figure 1:
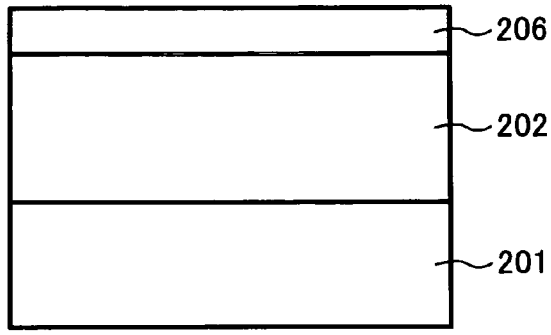
FIG. 1 is a cross-sectional view illustrating an embodiment of layer composition of the electrostatic latent image bearer of the present invention.

FIG. 1 is a cross-sectional view illustrating an embodiment of layer composition of the electrostatic latent image bearer of the present invention, wherein a photosensitive layer 202 (single-layered photosensitive layer) and a protective layer 206 are formed on a substrate 201, and an intermediate layer and other layers may optionally be formed thereon.

Figure 2:
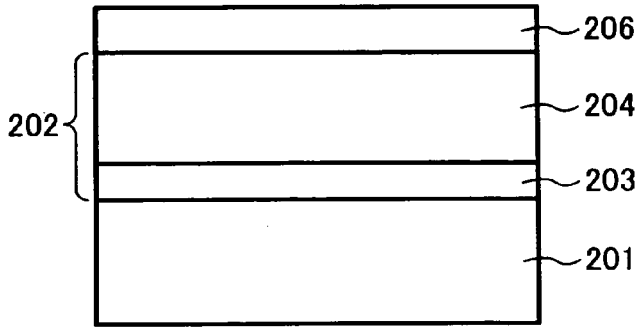
FIG. 2 is a cross-sectional view illustrating another embodiment of layer composition of the electrostatic latent image bearer of the present invention.

In FIG. 2, a photosensitive layer 202 is functionally separated into a charge generation layer (CGL) 203 and a charge transport layer (CTL) 204, and a protective layer 206 is formed thereon.

Figure 3:
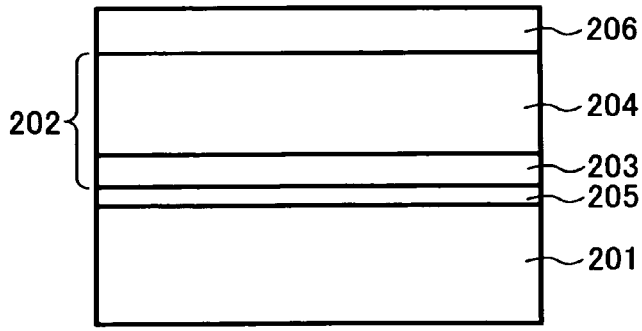
FIG. 3 is a cross-sectional view illustrating a further embodiment of layer composition of the electrostatic latent image bearer of the present invention.

In FIG. 3, an undercoat layer 205 is formed between a substrate 201 and a photosensitive layer 202 functionally separated into a charge generation layer (CGL) 203 and a charge transport layer (CTL) 204.

Figure 4:
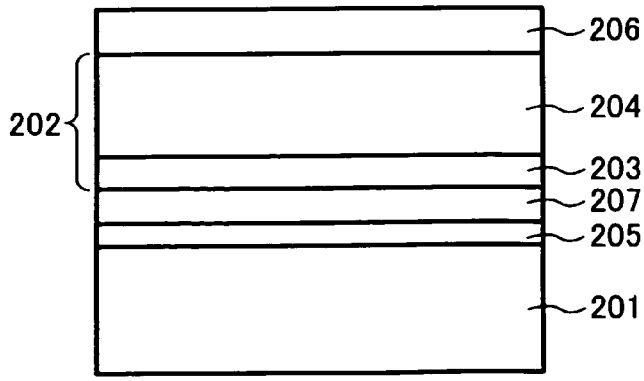
FIG. 4 is a cross-sectional view illustrating another embodiment of layer composition of the electrostatic latent image bearer of the present invention.

In FIG. 4, an intermediate layer 207 is formed between an undercoat layer 205 and a photosensitive layer 202.

The electrostatic latent image bearer of the present invention includes at least a photosensitive layer 202 and a protective layer 206 on a substrate 201, and the other layers and the types of the photosensitive layer may be combined as desired.

In FIGS. 2 to 4, the charge generation layer (CGL) 203 and the charge transport layer (CTL) 204 may be replaceable.

The protective layer of the electrostatic latent image bearer of the present invention includes at least polyol, polyisocyanate and an organic silicon compound having a hydroxyl or a hydrolyzable group. The organic silicon compound is preferably a hardening siloxane resin. Further, the protective layer may optionally include the following other constituents.

When only the polyol and polyisocyanate are crosslinked upon application of heat, the resultant polyurethane resin has high abrasion resistance and can be used as a good binder for a protective layer from this viewpoint. However, the polyurethane resin in the protective layer alone has poor adhesiveness to the photosensitive layer, and the protective layer occasionally peels therefrom when used for long periods. Particularly, when the protective layer becomes thinner due to abrasion, the protective layer more easily peels and quickly disappears.

In the present invention, the polyol, the polyisocyanate and the organic silicon compound having a hydroxyl or a hydrolyzable group are crosslinked to form a binder resin of the protective layer, and which noticeably improves the adhesiveness thereof to a photosensitive layer and the protective layer scarcely peels.

The reason for this is not clarified, an alkyl group or an alkoxy groups combined with silicon included the organic silicon compound having a hydroxyl or a hydrolyzable group has high affinity with a thermoplastic resin such as a polycarbonate resin forming the photosensitive layer under the protective layer, and interactions therebetween are thought to be highly active at an interface of the photosensitive layer. The reason for the high affinity is thought to be the interaction or steric structure of a hydrocarbon structures.

When the organic silicon compound having a hydroxyl or a hydrolyzable group and high affinity with the photosensitive layer is mixed with the polyol and the polyisocyanate, combinations of each material, such as crosslinkage between the polyol and the polyisocyanate and a three-dimensional crosslinkage between a polyurethane resin and a hardening siloxane resin, are thought to form a intricately-intertwined structure. This is why the protective layer is thought to have high abrasion resistance and good adhesiveness.

Specific examples of the organic silicon compound having a hydroxyl or a hydrolyzable group include organic silicon compounds having a hydroxy group or an alkoxy group, i.e., compounds having a alkoxysilyl group, their partially-hydrolyzed condensations and mixtures thereof.

In addition, hardening siloxane resins such as a silicone resin, a modified-silicone resin and a silicone hard coat agent, which are prepared by optionally adding a polymer such as a catalyst, a crosslinker, an organosilica sol, a silane coupling agent and an acrylic polymer to the compounds having a alkoxysilyl group, their partially-hydrolyzed condensates and mixtures thereof and marketed as a binder and a coating material, are preferably used because of low cost and easy handling.

Specific examples of the organic silicon compound having a hydroxyl or a hydrolyzable group include tetraalkoxysilane; alkyltrialkoxysilane such as methyltriethoxysilane, and aryltrialkoxysilane such as phenyltriethoxysilane. Epoxy groups, methacryloyl groups or vinyl groups may be adopted to the compound.

The hydrolyzed condensate of the compound having an alkoxysilyl group can be prepared by known methods of adding a specified amount of water, a catalyst, etc. to the compound having an alkoxysilyl group.

Hardening siloxane resins prepared by optionally adding a polymer such as a catalyst, a crosslinker, an organosilica sol, a silane coupling agent and an acrylic polymer to the compounds having a alkoxysilyl group include marketed products such as a silicone hard coating material NSC1000 series from NIPPON FINE CHEMICAL CO., LTD; GR-COAT from Daicel Chemical Industries, Ltd., Glass Resin from Owens Corning, HEATLESS GLASS from OHASHI CHEMICAL INDUSTRIES LTD., NSC from NIPPON FINE CHEMICAL CO., LTD., glass solution GO150SX and GO200CL from Fine Glass Technology Co., Ltd.

Particularly, an easily-obtainable hardening siloxane resin having a long pot life when mixed with the polyol and polyisocyanate and forming a protective layer having high transparency is preferably used. Specific examples thereof include NSC1000 series from NIPPON FINE CHEMICAL CO., LTD.

The protective layer of the present invention preferably includes an organic silicon compound or a hardening siloxane resin in an amount of form 1 to 50% by weight, and more preferably from 5 to 20% by weight based on total weight of the binder resin.

When less than 1% by weight, the protective layer does not have sufficient adhesiveness to the photosensitive layer. When greater than 50% by weight, the protective layer occasionally becomes clouded. The reason for this is thought to be poor compatibility between the hardening siloxane resin and a polyurethane resin formed of the polyol and polyisocyanate or between the hardening siloxane resin and a binder resin and charge transport material in the photosensitive layer. When such a photoreceptor is installed in an image forming apparatus, the lubricity between the protective layer and a cleaning blade is so low that the blade occasionally reverses or makes a scraping noise.

The polyol used for forming the protective layer of the present invention includes diols and tri- or more polyols.

Specific examples of the diols include alkylene glycols, alkylene ether glycols, alicyclic diols, bisphenols, alkylene oxide adducts of alicyclic diols, alkylene oxide adducts of bisphenols, etc.

Specific examples of the alkylene glycols include ethylene glycol, 1,2-propylene glycol, 1,3-propylene glycol, 1,4-butanediol and 1,6-hexanediol. Specific examples of the alkylene ether glycols include diethylene glycol, triethylene glycol, dipropylene glycol, polyethylene glycol, polypropylene glycol and polytetramethylene ether glycol. Specific examples of the alicyclic diols include 1,4-cyclohexanedimethanol and hydrogenated bisphenol A. Specific examples of the bisphenols include bisphenol A, bisphenol F and bisphenol S. Specific examples of the alkylene oxide adducts of alicyclic diols include adducts of the alicyclic diols mentioned above with an alkylene oxide (e.g., ethylene oxide, propylene oxide and butylene oxide). Specific examples of the alkylene oxide adducts of bisphenols include adducts of the bisphenols mentioned above with an alkylene oxide (e.g., ethylene oxide, propylene oxide and butylene oxide).

Specific examples of the tri- or more polyols include multivalent aliphatic alcohol such as glycerin, trimethylolethane, trimethylolpropane, pentaerythritol and sorbitol; phenols having 3 or more valences such as trisphenol PA, phenolnovolak, cresolnovolak; and adducts of the above-mentioned polyphenol having 3 or more valences with an alkylene oxide.

Particularly, the trimethylolpropane or a styrene-acrylic copolymer a hydroxyethyl group is introduced into, having the following formula (I) and a number-average molecular weight not less than 1,000 and a weight-average molecular weight about 31,000, is preferably used.

(I)

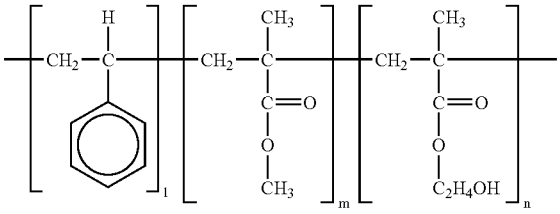

wherein l is 28, m is 42 and n is 30.

pecific examples thereof include a styrene-acrylic copolymer LZR-170 from FUJIKURA KASEI CO., LTD.

In addition, polyols having a polyether skeleton, a polyester skeleton, an acrylic skeleton, an epoxy skeleton, a polycarbonate skeleton, a charge generation molecule skeleton or a charge transport molecule skeleton are also used.

In the present invention, the polyols can be used alone or in combination.

At least one of the polyols preferably has a ratio of the molecular weight to the number of hydroxyl groups (molecular weight/the number of hydroxyl groups=OH equivalent) not less than 30 and less than 150, and more preferably not less than 40 and less than 120.

The combination of a polyol having an OH equivalent not less than 30 and less than 150 can from a protective layer having high abrasion resistance. When a protective layer includes the polyol having a small OH equivalent more, the abrasion resistance thereof is thought to improve because the crosslink density increases to form a finer three-dimensional network.

However, such a protective layer tends to have less adhesiveness, but the protective layer of the present invention includes a polyol having a small OH equivalent more while including an organic silicon compound having a hydroxyl or a hydrolyzable group improves the adhesiveness. Therefore, the protective layer of the present invention has higher abrasion resistance than a protective layer including a conventional thermosetting resin, and good adhesiveness to a photosensitive layer without peeling therefrom.

The protective layer of the present invention preferably includes a polyol having an OH equivalent not less than 30 and less than 150 in an amount of 10 to 90% by weight based on total weight of the polyols.

When less than 10%, the protective layer does not effect the abrasion resistance well. When greater than 90%, the coating liquid has lower storage stability and has a shorter life because of having more functional groups and higher reactivity although the resultant protective layer has higher abrasion resistance. Therefore, the coating liquid possibly becomes a large amount of an organic waste liquid. In addition, the coating liquid has more crosslinking points and a large volume contraction, resulting in coating defects such as coating cracks and holes.

In addition, at least one of the polyols preferably has an OH equivalent not less than 150. and less than 1,500. Such a coating liquid has good film formability and very good storage stability.

This is because the polyols having an OH equivalent not less than 150 and less than 1,500 has comparatively a large molecular weight and is though to give a moderate viscosity to the coating liquid, maintains uniform mixing state of the polyol having a small OH equivalent, the polyisocyanate and the organic silicon compound having a hydroxyl or a hydrolyzable group, and improves leveling and uniformity of the wet coating.

Specific examples of the polyisocyanates (PIC) include aliphatic polyisocyanates such as tetramethylenediisocyanate, hexamethylenediisocyanate and 2,6-diisocyanatemethylcaproate; alicyclic polyisocyanates such as isophoronediisocyanate and cyclohexylmethanediisocyanate; aromatic diisocianates such as tolylene diisocyanate and diphenylmethane diisocyanate; aromatic aliphatic diisocyanates such as α, α, α', α'-tetramethylxylylenediisocyanate; isocyanurates; blocked polyisocyanates in which the polyisocyanates mentioned above are blocked with phenol derivatives, oximes or caprolactams; etc. These can be used alone or in combination. Alternatively, a trimer formed of isocyanate compounds, such as hexamethylenediisocyanate trimer can also be used.

Further, an adduct of trimethylolpropane and an aliphatic polyisocyanate such as hexamethylenediisocyanate or an alicyclic polyisocyanate such as isophoronediisocyanate is preferably used. An embodiment of the adduct of trimethylolpropane and hexamethylenediisocyanate has the following formula (II).

(II)

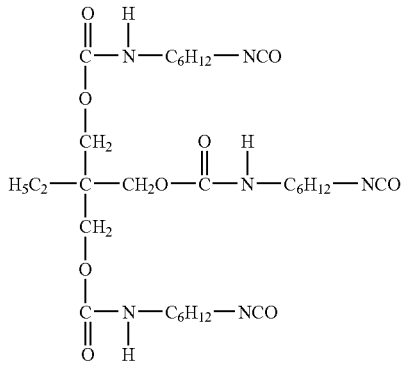

A marketed product of the polyisocyanate can be used. The adducts of trimethylolpropane and hexamethylenediisocyanate include Sumidule HT from Sumitomo Bayer Urethane Co., Ltd.

In addition, polyisocyanate having a charge generation molecule skeleton or a charge transport molecule skeleton can also be used.

The protective layer of the present invention may include an electroconductive particulate material to decrease the residual potential of the irradiated part. The electroconductive particulate material has the following formula:

$$M_xSb_yO_z$$

wherein M represents a metallic element; and x, y and z represent molar ratios for respective elements. The metallic elements M include Zn, In, Sn, Ti and Zr, and Zn and In are preferably used.

When Zn is used, x, y and z are 1:1.6 to 2.4:5 to 7. When In is used, 1:0.02 to 1.25:1.55 to 4.63.

Specific examples of the electroconductive particulate material include zinc antimonate ($ZnSb_2O_6$) disclosed in Japanese Patent No. 3221132, indium antimonate ($InSbO_4$) disclosed in Japanese Patent No. 3198494, etc.

The zinc antimonate is commercially available as an electroconductive sol dispersed in a solvent in the form of a colloid (selnax series from NISSAN CHEMICAL INDUSTRIES, LTD.). Specific examples of the method of dispersing the electroconductive particulate material include known methods, and high-speed liquid collision dispersion methods using the MICROFLUIDIZER from MFIC CORP., ULTIMIZER from SUGINO MACHINE LIMITED, etc. are preferably used.

The outermost layer of the electrostatic latent image bearer including the electroconductive particulate material typically has a smaller bulk resistance, which is disadvantageous to maintaining the electrostaticity on the surface thereof, resulting in increase of blurred image production. However, the electroconductive particulate material reduces the residual potential of the irradiated parts of the electrostatic latent image bearer and prevents the production of blurred images. In addition, the electroconductive particulate material is an inorganic filler improving the abrasion resistance thereof.

The reason why the electroconductive particulate material reduces the residual potential of the irradiated parts of the electrostatic latent image bearer and prevents the production of blurred images is not clarified yet, however the electroconductive particulate material transports a charge not with an ion transport mechanism but with an electron transport mechanism, and is considered to be less affected by the environment such as a temperature and a humidity. In addition, even a slight content thereof reduces the residual potential of the irradiated parts of the electrostatic latent image bearer, and the irradiated parts have a desired potential without reducing the bulk resistance of the outermost layer too much. The reason why the blurred images are improved is considered that the electroconductive particulate material having quite a small particle diameter, uniformly dispersed in the outermost layer, localizes the electrostaticity close thereto to prevent the transport of the electrostaticity on the surface of the outermost layer. Therefore, the edge of an electrostatic latent image is more sharply developed and the production of blurred images is prevented.

The electroconductive particulate material preferably has a volume-average particle diameter of from 0.01 to 1 μm, and more preferably from 0.01 to 0.5 μm. When less than 0.01 μm, distances between the electroconductive particulate materials are so short that the electrostaticity on the surface of the outermost layer is not sufficiently maintained. In addition, the electroconductive particulate materials agglutinate to form secondary particles having nonuniform particle diameters in a coating liquid, resulting in large particles localized in the layer, causing abnormal images due to lower potentials of non-irradiated parts, i.e., granular background foulings in negative-positive developing methods and white spotted images in positive-positive developing methods. When larger than 1 μm, the electroconductive particulate materials are so large that the surface roughness of a photoreceptor becomes large, resulting in poor cleaning because a toner, particularly a spherical toner difficult to clean with a blade, scrapes through a cleaning blade.

The protective layer preferably includes the electroconductive particulate material in an amount of 1 to 65% by weight, and more preferably from 5 to 45% by weight. When less than 1% by weight, the residual potential is not sufficiently reduced and the abrasion resistance of the layer is not improved. When greater than 65% by weight, the bulk resistance thereof becomes so low that blurred images are produced and the layer becomes brittle, resulting in deterioration of the abrasion resistance.

The protective layer may include a particulate material besides the electroconductive particulate material.

When the particulate material is used in combination with the electroconductive particulate material, the content of the electroconductive particulate material is preferably from 10 to 100% by weight, and more preferably from 50 to 100% by weight based on total weight of the particulate materials. When less than 10% by weight, the residual potential is not sufficiently reduced and the production of blurred images not sufficiently prevented.

In addition, protective layer may include a charge transport material to decrease the residual potential of the irradiated part.

A CTL including a low-molecular-weight charge transport material in a polymer binder resin is known to typically decrease the abrasion resistance as the CTL includes the low-molecular-weight charge transport material more.

In the present invention, when the charge transport material has a (crosslinking) functional group reactive with anyone of the polyol, the polyisocyanate and the organic silicon compound having a hydroxyl or a hydrolyzable group used for forming a binder resin, the charge transport material is no more a low-molecular-weight component and the deterioration of the abrasion resistance of the protective layer can be minimized.

Particularly, a multifunctional charge transport material having two or more functional groups is preferably used because it is thought to crosslink with a binder resin at two or more crosslinking points to form a three-dimensional network. Specific examples of the crosslinking functional groups include charge transport materials having crosslinking functional groups such as a hydroxyl group, a mercapto group and an amine group in consideration of a reaction with the organic silicon compound having a hydroxyl or a hydrolyzable group. In consideration of a reaction with a urethane resin, charge transport materials having a hydroxyl group or an isocyanate group are preferably used.

The protective layer preferably has a mixing weight ratio (D/R) of the charge transport material (D) to the binder resin (R) of from 1/10 to 15/10, and more preferably from 3/10 to 10/10. When less than 1/10, the charge transportability is insufficient, resulting in occasional increase of the residual potential. When greater than 15/10, the binder resin is too few that the formation of three-dimensional network is obstructed, resulting in occasional deterioration of the abrasion resistance.

Further, the protective layer can optionally include various additives for the purpose of improving adhesiveness, smoothness and chemical stability.

The protective layer of the present invention is formed on a photosensitive layer by a conventional coating method such as a dip coating method, a spray coating method, a blade coating method and a knife coating method. Particularly, the dip coating method and spray coating method are advantageously used in terms of mass-productiveness and coated layer quality.

The protective layer preferably has a thickness of from 1 to 15 μm, and more preferably from 2 to 10 μm. When less than 1 μm, the protective layer quickly disappears due to abrasion and the resultant photoreceptor does not have sufficient durability. When thicker than 15 μm, the residual potential increases.

Next, a multilayered photosensitive layer and a single-layered photosensitive layer of the photosensitive layer of the present invention will be explained.

The multilayered photosensitive layer typically includes a CGL and a CTL in this order on a substrate.

The CGL includes at least a charge generation material, and optionally a binder resin and other constituents. The charge generation materials are not particularly limited, and can be selected in accordance with the purpose. Suitable charge generation materials include inorganic materials and organic materials.

The inorganic materials are not particularly limited, and can be selected in accordance with the purpose. Specific examples of the inorganic charge generation materials include crystalline selenium, amorphous selenium, selenium-tellurium alloys, selenium-tellurium-halogen alloys and selenium-arsenic alloys.

Specific examples of the organic charge generation materials include known materials, for example, phthalocyanine pigments such as metal phthalocyanine and metal-free phthalocyanine, azulenium pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bisstilbene skeleton, azo pigments having a distyryloxadiazole skeleton, azo pigments having a distyrylcarbazole skeleton, perylene pigments, anthraquinone pigments, polycyclic quinone pigments, quinoneimine pigments, diphenyl methane pigments, triphenyl methane pigments, benzoquinone pigments, naphthoquinone pigments, cyanine pigments, azomethine pigments, indigoid pigments, bisbenzimidazole pigments and the like materials. These can be used alone or in combination.

Specific examples of the binder resin optionally used in the CGL include polyamide resins, polyurethane resins, epoxy resins, polyketone resins, polycarbonate resins, silicone resins, acrylic resins, polyvinyl butyral resins, polyvinyl formal resins, polyvinyl ketone resins, polystyrene resins, poly-N-vinylcarbazole resins, polyacrylamide resins, and the like resins. These resins can be used alone or in combination.

In addition, a low-molecular-weight charge transport material may optionally be included in the CGL. Further, a charge transport polymer material is preferably used as the binder resin in the CGL as well besides the above-mentioned binder resins.

Suitable methods for forming the CGL include thin film forming methods in a vacuum and casting methods using a solution or a dispersion.

Specific examples of the former methods include vacuum evaporation methods, glow discharge decomposition methods, ion plating methods, sputtering methods, reaction sputtering methods, CVD methods, and the like methods. A layer of the above-mentioned inorganic and organic materials can preferably be formed by these methods.

The latter casting methods for forming the CGL include preparing a CGL coating liquid and coating the liquid on a substrate by a dip coating method, a spray coating method, a bead coating method, etc.

Specific examples of an organic solvent for use in the CGL coating liquid include acetone, methyl ethyl ketone, methyl isopropyl ketone, cyclohexanone, benzene, toluene, xylene, chloroform, dichloromethane, dichloroethane, dichloropropane, trichloroethane, trichloroethylene, tetrachloroethane, tetrahydrofuran, dioxolane, dioxane, methanol, ethanol, isopropylalcohol, butanol, ethylacetate, butylacetate, dimethylsulfoxide, methylcellosolve, ethylcellosolve, propylcellosolve, etc. These can be used alone or in combination.

Among these solvents, tetrahydrofuran, methyl ethyl ketone, dichloromethane, methanol and ethanol having a boiling point of from 40 to 80° C. are preferably used because of being easily dried after coated.

The CGL coating liquid is prepared by dispersing and dissolving the charge generation material and optionally the binder resin in the organic solvent. The organic pigment is dispersed therein by dispersion methods using dispersion media such as a ball mill, a beads mill, a sand mill and vibration mill; and high-speed collision dispersion methods.

The thicker the CGL, the higher the photosensitivity. Therefore, it is preferable to make the CGL have a thickness based on the specification of an image forming apparatus. Typically, the CGL preferably has a thickness of form 0.01 to 5 μm, and more preferably from 0.05 to 2 μm such that the resultant photoreceptor has a sensitivity required for electrophotographic methods.

The CTL maintains electrostaticity formed on the photosensitive layer, transports the carriers, which are selectively generated in the CGL by light irradiation, and couples the carriers with the electrostaticity. Therefore, the CTL is required to have a high electric resistance to maintain electrostaticity, and a small dielectric constant and large charge transportability to obtain a high surface potential with the electrostaticity maintained on the photosensitive layer.

The CTL includes at least a charge transport material and a binder resin, and optionally other constituents.

The charge transport materials include positive hole transport materials, electron transport materials and charge transport polymer materials.

Specific examples of the electron transport (electron-accepting) materials include chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrobenzothiophene-5,5-dioxide, and the like compounds. These can be used alone or in combination.

Specific examples of the positive hole transport (electron-releasing) materials include oxazole derivatives, oxadiazole derivatives, imidazole derivatives, triphenylamine derivatives, 9-(p-diethylaminostyrylanthracene), 1,1-bis(4-dibenzylaminophenyl)propane, styrylanthracene, styrylpyrazoline, phenylhydrazone compounds, α-phenylstilbene derivatives, thiazole derivatives, triazole derivatives, phenazine derivatives, acridine derivatives, benzofuran derivatives, benzimidazole derivatives, thiophene derivatives, and the like materials. These can be used alone or in combination.

The charge transport polymer materials have the following constitutions.

(a) Polymers Having a Carbazole Ring

Specific examples of such polymers include poly-N-vinyl carbazole, and compounds disclosed in Japanese Laid-Open Patent Publications Nos. 50-82056, 54-9632, 54-11737, 4-175337, 4-183719 and 6-234841.

(b) Polymers Having a Hydrazone Skeleton

Specific examples of such polymers include compounds disclosed in Japanese Laid-Open Patent Publications Nos. 57-78402, 61-20953, 61-296358, 1-134456, 1-179164, 3-180851, 3-180852, 3-50555, 5-310904 and 6-234840.

(c) Polysilylene Polymers

Specific examples of such polymers include polysilylene compounds disclosed in Japanese Laid-Open Patent Publications Nos. 63-285552, 1-88461, 4-264130, 4-264131, 4-264132, 4-264133 and 4-289867.

(d) Polymers Having a Triaryl Amine Skeleton

Specific examples of such polymers include N,N-bis(4-methylphenyl)-4-aminopolystyrene, and compounds disclosed in Japanese Laid-Open Patent Publications Nos. 1-134457, 2-282264, 2-304452, 4-133065, 4-133066, 5-40350 and 5-202135.

(e) Other Polymers

Specific examples of such polymers include condensation products of nitropyrene with formaldehyde, and compounds disclosed in Japanese Laid-Open Patent Publications Nos. 51-73888, 56-150749, 6-234836 and 6-234837.

Besides these charge transport polymer materials, polycarbonates, polyurethanes, polyesters and polyethers having a triaryl amine structure can also be used. Specific examples thereof include compounds in Japanese Laid-Open Patent Publications Nos. 64-1728, 64-13061, 64-19049, 4-11627, 4-225014, 4-230767, 4-320420, 5-232727, 7-56374, 9-127713, 9-222740, 9-265197, 9-211877 and 9-304956.

Polymers having an electron-releasing group for use in the present invention is not limited to the polymers mentioned above, and any known copolymers, block copolymers and graft copolymers and star polymers of known monomers can also be used. In addition, crosslinking polymers having an electron donating group disclosed in, for example, Japanese Laid-Open Patent Publication No. 3-109406 can also be used.

Specific examples of the binder resin for use in the CTL include polycarbonate, polyester, methacrylic resins, acrylic resins, polyethylene, vinylchloride, vinylacetate, polystyrene, phenol resins, epoxy resins, polyurethane, polyvinylidenechloride, alkyd resins, silicone resins, polyvinylcarbazole, polyvinylbutyral, polyvinylformal, polyacrylate, polyacrylamide and phenoxy resins. These binder resins can be used alone or in combination.

The CTL can include a copolymer formed from a crosslinking binder resin and a crosslinking charge transport material.

The CTL is formed by dissolving or dispersing the transport material and binder resin in a proper solvent to prepare a coating liquid, and coating and drying the coating liquid. The CTL may optionally include an additive such as a plasticizer, an antioxidant, a leveling agent in a proper amount besides the transport material and binder resin.

The CTL preferably has a thickness of from 5 to 100 μm, and more preferably from thinner 5 to 30 μm due to recent requirements for higher image quality to produce high-quality images having not less than 1,200 dpi.

The single-layered photosensitive layer includes a charge generation material, a charge transport material and a binder resin, and optionally other constituents.

When the single-layered photosensitive layer is formed by a casting method, the single-layered photosensitive layer can be formed by dissolving or dispersing a charge generation material, low-molecular-weight charge transport material and a charge transport polymer material in a proper solvent to prepare a solution or a dispersion liquid; and coating and drying the solution or dispersion liquid in many cases. In addition, the single-layered photosensitive layer can optionally include a plasticizer.

The single-layered photosensitive layer preferably has a thickness of from 5 to 100 μm, and more preferably from 5 to 50 μm. When less than 5 μm, the chargeability of the resultant photoreceptor occasionally deteriorates. When thicker than 100 μm, the sensitivity thereof occasionally deteriorates.

The substrates are not particularly limited if electroconductive, and can be selected in accordance with the purpose. Electroconductive materials and insulators subjected to an electroconductive treatment are preferably used. For example, metals such as Al, Fe, Cu, and Au or metal alloys thereof; materials in which a thin layer of a metal such as Al, Ag and Au or a conductive material such as In2O3 and SnO2 is formed on an insulating substrate such as polyester resins, polycarbonate resins, polyimide resins, and glass; and paper subjected to an electroconductive treatment can also be used.

Shapes of the electroconductive substrate are not particularly limited, and any substrates having a plate shape, a drum shape or a belt shape can be used. When a belt-shaped substrate is used, a layout in an image forming apparatus can more freely be designed although the apparatus becomes complicated or large because of needing a drive roller and a driven roller therein. However, when a protective layer is formed as an outermost layer on the belt-shaped substrate, the protective layer runs short of flexibility and occasionally has a crack on a surface thereof, which possibly causes production of images having background fouling. Therefore, a drum-shaped substrate having a high stiffness is preferably used.

An undercoat layer may be formed between the substrate and the photosensitive layer. The undercoat layer is formed for the purpose of improving adherence of the photosensitive layer to the substrate, preventing moire, improving coating capability of the above layer and decreasing the residual potential.

The undercoat layer includes a resin as a main constituent. Since a photosensitive layer is typically formed on the undercoat layer by coating a liquid including an organic solvent, the resin in the undercoat layer preferably has good resistance to general organic solvents.

Specific examples of such resins-include water-soluble resins such as polyvinyl alcohol resins, casein and polyacrylic acid sodium salts; alcohol soluble resins such as nylon copolymers and methoxymethylated nylon resins; and hardening resins capable of forming a three-dimensional network such as polyurethane resins, melamine resins, alkyd-melamine resins, epoxy resins, etc.

The undercoat layer may include a fine powder of metal oxides such as titanium oxide, silica, alumina, zirconium oxide, tin oxide and indium oxide to prevent occurrence of moire in the recorded images and to decrease residual potential of the photoreceptor. The undercoat layer can be formed by using a proper solvent and a conventional coating method.

Further, a metal oxide layer formed by, e.g., a sol-gel method using a silane coupling agent, titanium coupling agent or a chromium coupling agent, a layer of aluminum oxide which is formed by an anodic oxidation method and a layer of an organic compound such as polyparaxylylene (parylene) or an inorganic compound such as SiO, $SnO_2$, $TiO_2$, ITO or $CeO_2$ which is formed by a vacuum evaporation method is can be used as the undercoat layer.

The undercoat layer preferably has a thickness of from 0.1 to 10 μm, and more preferably from 1 to 5 μm.

The electrostatic latent image bearer (photoreceptor) may optionally include an intermediate layer between the undercoat layer and the photosensitive layer to improve the adhesiveness and charge blocking capability.

The intermediate layer includes a resin as a main constituent. Since a photosensitive layer is typically formed on the intermediate layer by coating a liquid including an organic solvent, the resin in the intermediate layer preferably has good resistance to general organic solvents.

Specific examples of such resins include water-soluble resins such as polyvinyl alcohol resins, casein and polyacrylic acid sodium salts; alcohol soluble resins such as nylon copolymers and methoxymethylated nylon resins; and hardening resins capable of forming a three-dimensional network such as polyurethane resins, melamine resins, alkyd-melamine resins, epoxy resins, etc.

Next, the image forming apparatus and image forming method of the present invention will be explained.

The image forming apparatus of the present invention includes at least an electrostatic latent image bearer having a protective layer, an electrostatic latent image former forming an electrostatic latent image on the electrostatic latent image bearer, an image developer visualizing the electrostatic latent image with a toner, a transferer transferring the visualized image onto a recording medium, and a fixer fixing the transferred image thereon, wherein the protective layer includes a binder resin formed of crosslinked polyol, polyisocyanate and an organic silicon compound having a hydroxyl or a hydrolyzable group.

The image forming apparatus of the present invention can optionally includes other means such as a discharger, a cleaner, a recycler and a controller.

The cleaner preferably contacts the surface of the electrostatic latent image bearer to remove a residual toner thereon.

The image forming method of the present invention is preferably performed by the image forming apparatus of the present invention. The electrostatic latent image forming process is performed by the electrostatic latent image former. The development process is performed by the image developer. The transfer process is performed by the transferer. The fixing process is performed by the fixer. The other processes are performed by the other means.

The image forming method of the present invention includes at least an electrostatic latent image forming process forming an electrostatic latent image on an electrostatic latent image bearer, a developing process visualizing the electrostatic latent image with a toner, a transfer process transferring the visualized image onto a recording medium and a fixing process fixing the transferred image thereon, wherein the protective layer includes a binder resin formed of crosslinked polyol, polyisocyanate and an organic silicon compound having a hydroxyl or a hydrolyzable group. The image forming method of the present invention optionally includes other processes such as a discharge process, a cleaning process, a recycle process and a control process.

Each process and means will be explained.

The electrostatic latent image forming process is a process of forming an electrostatic latent image on an electrostatic latent image bearer.

The electrostatic latent image bearer is the electrostatic latent image bearer of the present invention.

The electrostatic latent image is formed by uniformly charging the surface of the electrostatic latent image bearer and irradiating imagewise light onto the surface thereof with the electrostatic latent image former.

The electrostatic latent image former includes at least a charger uniformly charging the surface of the electrostatic latent image bearer and an irradiator irradiating imagewise light onto the surface thereof.

The surface of the electrostatic latent image bearer is charged with the charger upon application of voltage.

The charger is not particularly limited, and can be selected in accordance with the purpose, such as an electroconductive or semiconductive rollers, brushes, films, known contact chargers with a rubber blade, and non-contact chargers using a corona discharge such as corotron and scorotron, and a gap applicator applying a gap tape at the end of a roller to be located close to the electrostatic latent image bearer.

The charger may have any shapes besides the roller such as magnetic brushes and fur brushes, and is selectable according to a specification or a form of the electrophotographic image forming apparatus. The magnetic brush is formed of various ferrite particles such as Zn—Cu ferrite as a charging member, a non-magnetic electroconductive sleeve supporting the charging member and a magnet roll included by the non-magnetic electroconductive sleeve. The fur brush is a charger formed of a shaft subjected to an electroconductive treatment and a fur subjected to an electroconductive treatment with, e.g., carbon, copper sulfide, metals and metal oxides winding around or adhering to the shaft.

The charger is not limited to contact chargers, however, the contact chargers or non-contact chargers using a gap applicator to be locate close to the electrostatic latent image bearer are preferably used because of reducing ozone generating therefrom.

The charger being located in contact with or not in contact with an electrostatic latent image bearer preferably charge the surface thereof when applied with a DC voltage overlapped with an AC voltage.

In addition, the charging roller being located not in contact with an electrostatic latent image bearer through a gap tape preferably charge the surface thereof when applied with a DC voltage overlapped with an AC voltage.

The surface of the electrostatic latent image bearer is irradiated with the imagewise light by the irradiator.

The irradiator is not particularly limited, and can be selected in accordance with the purpose, provided that the irradiator can irradiate the surface of the electrostatic latent image bearer with the imagewise light, such as reprographic optical irradiators, rod lens array irradiators, laser optical irradiators and a liquid crystal shutter optical irradiators.

In the present invention, a backside irradiation method irradiating the surface of the electrostatic latent image bearer through the backside thereof may be used.

A visible image is formed by the image developer developing the electrostatic latent image with a toner or a developer mentioned later. The image developer is not particularly limited, and can be selected from known image developers, provided that the image developer can develop with the toner or developer. For example, an image developer containing the toner or developer and being capable of giving the toner or developer to the electrostatic latent image in contact or not in contact therewith is preferably used.

The image developer may use a dry developing method or a wet developing method, and may develop a single color or multiple colors. For example, an image developer including a stirrer stirring the toner or developer to be charged and a rotatable magnet roller is preferably used.

In the image developer, the toner and the carrier are mixed and stirred, and the toner is charged and held on the surface of the rotatable magnet roller in the shape of an ear to form a magnetic brush. Since the magnet roller is located close to the electrostatic latent image bearer (photoreceptor), a part of the toner is electrically attracted to the surface thereof. Consequently, the electrostatic latent image is developed with the toner to form a visible image thereon.

The developer contained in the image developer may be a one-component developer or a two-component developer.

It is preferable that the visible image is firstly transferred onto an intermediate transferer and secondly transferred onto a recording medium thereby. It is more preferable that two or more visible color images are firstly and sequentially transferred onto the intermediate transferer and the resultant complex full-color image is transferred onto the recording medium thereby.

The visible image is transferred by the transferer using a transfer charger charging the electrostatic latent image bearer (photoreceptor). The transferer preferably includes a first transferer transferring the two or more visible color images onto the intermediate transferer and a second transferer transferring the resultant complex full-color image onto the recording medium.

The intermediate transferer is not particularly limited, and can be selected from known transferers in accordance with the purpose, such as a transfer belt.

The intermediate transferer preferably has a static friction coefficient of from 0.1 to 0.6, and more preferably from 0.3 to 0.5. In addition, the intermediate transferer preferably has a volume resistance of from several to $10^3$ Ωcm. When the intermediate transferer has a volume resistance of from several to $10^3$ Ωcm, it is prevented that the intermediate transferer itself is charged and a charge is difficult to remain thereon to prevent an uneven second transfer. Further, a transfer bias can easily be applied thereto.

Materials therefor are not limited and any known materials can be used. Specific examples thereof include (1) a single layer belt formed of a material having high Young's modulus (tensile elasticity) such as PC (polycarbonate), PVDF (polyvinylidenefluoride), PAT (polyalkyleneterephthalate), a mixture of PC and PAT, a mixture of ETFE (ethylenetetrafluoroethylene copolymer) and PC, a mixture of ETFE and PAT, a mixture of PC and PAT and a thermosetting polyimide in which carbon black dispersed, which has a small transformed amount against a stress when an image is formed; (2) a two or three layer belt including a surface layer or an intermediate layer based on the above-mentioned belt having high Young's modulus, which prevents hollow line images due to a hardness of the single layer belt; and (3) a belt formed of a rubber and an elastomer having comparatively a low Young's modulus, which has an advantage of scarcely producing hollow line images due to its softness, and being low-cost because of not needing a rib or a meandering inhibitor when the belt is wider than a driving roller and an extension roller such that an elasticity of an edge of the belt projecting therefrom prevents the meandering.

The intermediate transfer belt is conventionally formed of a fluorocarbon resin, a polycarbonate resin and a polyimide resin. However, an elastic belt which is wholly or partially an elastic member is used recently.

A full-color image is typically formed of 4 colored toners. The full-color image includes 1 to 4 toner layers. The toner layer receives a pressure from a first transfer (transfer from a photoreceptor to an intermediate transfer belt) and a second transfer (from the intermediate transfer belt to a sheet), and agglutinability of the toner increases, resulting in production of hollow letter images and edgeless solid images. Since a resin belt has a high hardness and does not transform according to a toner layer, it tends to compress the toner layer, resulting in production of hollow letter images.

Recently, demands for forming an image on various sheets such as a Japanese paper and a sheet purposefully having a concavity and convexity are increasing. However, a paper having a poor smoothness tends to have an air gap with a toner when transferred thereon and hollow images tend to be produced thereon. When a transfer pressure of the second transfer is increased to increase an adhesion of the toner to the paper, agglutinability of the toner increases, resulting in production of hollow letter images.

The elastic belt transforms according to a toner layer and a sheet having a poor smoothness at a transfer point. Since the elastic belt transforms following to a local concavity and convexity, it adheres a toner to a paper well without giving an excessive transfer pressure to a toner layer, and therefore a transfer image having good uniformity can be formed even on a sheet having a poor smoothness without hollow letter images. Specific examples of the resin for the elastic belt include polycarbonate; fluorocarbon resins such as ETFE and PVDF; styrene resins (polymers or copolymers including styrene or a styrene substituent) such as polystyrene, chloropolystyrene, poly-α-methylstyrene, a styrene-butadiene copolymer, a styrene-vinylchloride copolymer, a styrene-vinylacetate copolymer, a styrene-maleate copolymer, a styrene-esteracrylate copolymer (a styrene-methylacrylate copolymer, a styrene-ethylacrylate copolymer, a styrene-butylacrylate copolymer, a styrene-octylacrylate copolymer and a styrene-phenylacrylate copolymer), a styrene-estermethacrylate copolymer (a styrene-methylmethacrylate copolymer, a styrene-ethylmethacrylate copolymer and a styrene-phenylmethacrylate copolymer), a styrene-α-methylchloroacrylate copolymer and a styrene-acrylonitrile-esteracrylate copolymer; a methylmethacrylate resin; a butyl methacrylate resin; an ethyl acrylate resin; a butyl acrylate resin; a modified acrylic resin such as a silicone-modified acrylic resin, a vinylchloride resin-modified acrylic resin and an acrylic urethane resin; a vinylchloride resin; a styrene-vinylacetate copolymer; a vinylchloride-vinyl-acetate copolymer; a rosin-modified maleic acid resin; a phenol resin; an epoxy resin; a polyester resin; a polyester polyurethane resin; polyethylene; polypropylene; polybutadiene; polyvinylidenechloride; an ionomer resin; a polyurethane resin; a silicone resin; a ketone resin; an ethylene-ethylacrylate copolymer; a xylene resin; a polyvinylbutyral resin; a polyamide resin; a modified-polyphenyleneoxide resin, etc. These can be used alone or in combination.

Specific examples of an elastic rubber and an elastomer include a butyl rubber, a fluorinated rubber, an acrylic rubber, EPDM, NBR, an acrylonitrile-butadiene-styrene natural rubber, an isoprene rubber, a styrene-butadiene rubber, a butadiene rubber, an ethylene-propylene rubber, an ethylene-propylene terpolymer, a chloroprene rubber, chlolosulfonated polyethylene, chlorinated polyethylene, a urethane rubber, syndiotactic 1,2-polybutadiene, an epichlorohydrin rubber, a silicone rubber, a fluorine rubber, a polysulfide rubber, a polynorbornene rubber, a hydrogenated nitrile rubber; and a thermoplastic elastomer such as a polystyrene elastomer, a polyolefin elastomer, a polyvinylchloride elastomer, a polyurethane elastomer, a polyamide elastomer, a polyurea elastomer, a polyester elastomer and a fluorocarbon resin elastomer; etc. These can be used alone or in combination.

Specific examples of a conductant controlling a resistivity include a metallic powder such as carbon black, graphite, aluminium and nickel; and an electroconductive metal oxide such as a tin oxide, a titanium oxide, a antimony oxide, an indium oxide, kalium titanate, an antimony oxide-tin oxide complex oxide and an indium oxide-tin oxide complex oxide. The electroconductive metal oxide may be coated with an insulative particulate material such as barium sulfate, magnesium silicate and calcium carbonate. These are not limited thereto.

A surface layer material of the elastic material does not contaminate photoreceptor and decrease surface friction of a transfer belt to increase cleanability and second transferability of a toner. For example, one, or two or more of a polyurethane resin, a polyester resin and an epoxy resin can reduce a surface energy and increase a lubricity. A powder or a particulate material of one, or two or more of a fluorocarbon resin, a fluorine compound, fluorocarbon, a titanium dioxide, silicon carbide can be also used. A material having a surface layer including many fluorine atoms when heated, and having a small surface energy such as a fluorinated rubber can also be used.

The belt can be prepared by the following methods, but the methods are not limited thereto and the belt is typically prepared by combinations of plural methods.

(1) A centrifugal forming method of feeding materials into a rotating cylindrical mold.

(2) A spray coating method of spraying a liquid coating to form a film.

(3) A dipping method of dipping a cylindrical mold in a material solution.

(4) A casting method of casting materials into an inner mold and an outer mold.

(5) A method of winding a compound around a cylindrical mold to perform a vulcanizing grind.

As a method of preventing an elongation of the elastic belt, a method of forming a rubber layer on a resin layer having a hard center with less elongation and a method of including an elongation inhibitor in a layer having a hard center are used. However, these are not limited thereto.

Specific examples of the elongation inhibitor include a natural fiber such as cotton and silk; a synthetic fiber such as a polyester fiber, a nylon fiber, an acrylic fiber, a polyolefin fiber, a polyvinylalcohol fiber, a polyvinylchloride fiber, a polyvinylidenechloride fiber, a polyurethane fiber, a polyacetal fiber, a polyfluoroethylene fiber and a phenol fiber; an inorganic fiber such as a carbon fiber, a glass fiber and a boron fiber; and a metallic fiber such as an iron fiber and a copper fiber. These can be used alone or in combination in form of a fabric or a filament.

Specific examples of a method of preparing a layer having a hard center include a method of covering a cylindrically-woven fabric over a metallic mold and forming a coated layer thereon; a dipping a cylindrically-woven fabric in a liquid rubber and forming a coated layer on one side or both sides thereof; and a method of spirally winding a thread around a metallic mold and forming a coated layer thereon.

When the elastic layer is too thick, expansion and contraction of the surface becomes large and tends to have a crack, although depending on a hardness thereof. When the expansion and contraction of the surface becomes large, the resultant image largely expands and contracts. Therefore, it is not preferable that the elastic layer is too thick, but it preferably has a thickness not less than 1 mm.

The transferer may be one, or two or more, and includes a corona transferer using a corona discharge, a transfer belt, a transfer roller, a pressure transfer roller, an adhesive roller, etc.

The recording medium is not particularly limited, and can be selected from known recording media, e.g., typically a plain paper and even a PET film for OHP.

The visible image transferred onto the recording medium is fixed thereon by a fixer. Each color toner image or the resultant complex full-color image may be fixed thereon.

The fixer is not particularly limited, can be selected in accordance with the purpose, and known heating and pressurizing means are preferably used. The heating and pressurizing means include a combination of a heating roller and a pressure roller, and a combination of a heating roller, a pressure roller and an endless belt, etc. The heating temperature is preferably from 80 to 200° C.

In the present invention, a known optical fixer may be used with or instead of the fixer in accordance with the purpose.

The electrostatic latent image bearer is discharged by the discharger upon application of discharge bias.

The discharger is not particularly limited, and can be selected from known dischargers, provide that the discharger can apply the discharge bias to the electrostatic latent image bearer, such as a discharge lamp.

The toner remaining on the electrostatic latent image bearer is preferably removed by the cleaner.

The cleaner is not particularly limited, and can be selected from known cleaners, provide that the cleaner can remove the toner remaining thereon, such as a magnetic brush cleaner, an electrostatic brush cleaner, a magnetic roller cleaner, a blade cleaner, a brush cleaner and a web cleaner.

The image forming apparatus of the present invention preferably has a lubricant applicator applying a lubricant to the surface of an electrostatic latent image bearer. The lubricant is a member selected from the group consisting of metallic soaps, zinc stearate, aluminum stearate and calcium stearate.

The toner removed by the cleaner is recycled into the image developer with a recycler.

The recycler is not particularly limited, and known transporters can be used.

The controller is not particularly limited, and can be selected in accordance with the purpose, provided the controller can control the above-mentioned means, such as a sequencer and a computer.

Figure 5:
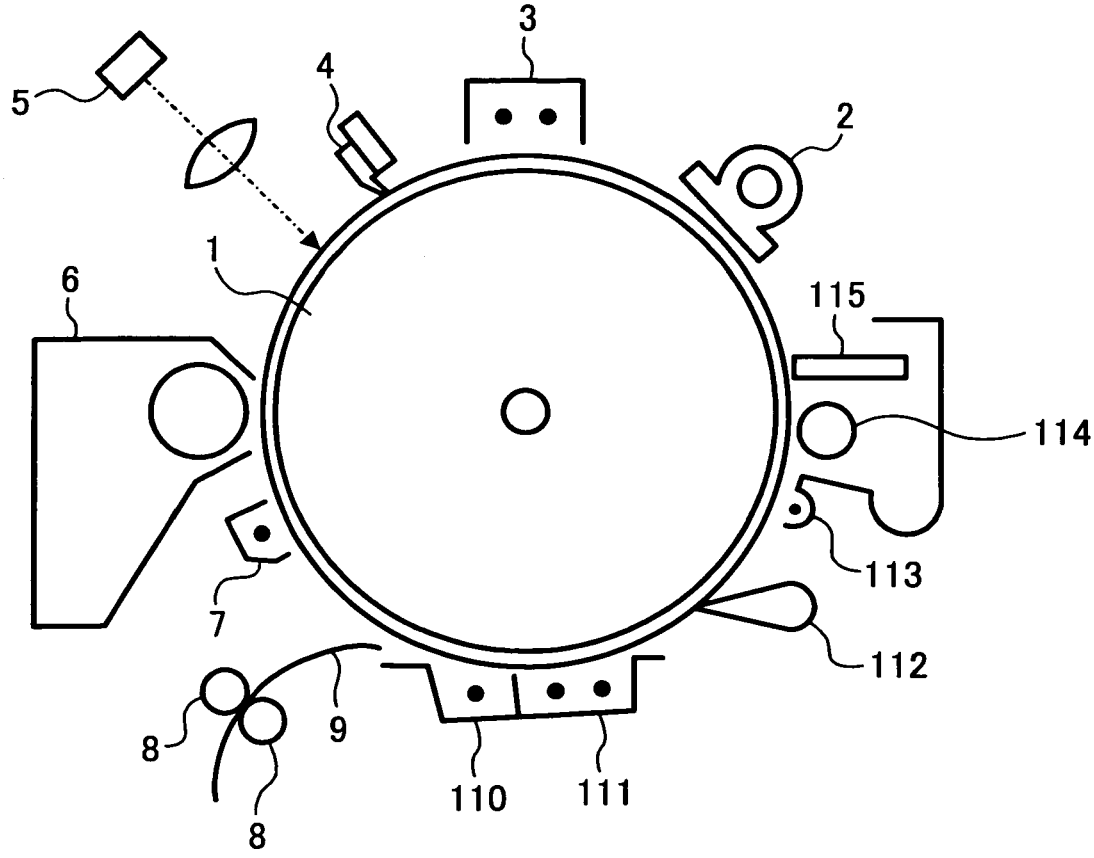
FIG. 5 is a schematic view illustrating an embodiment of the image forming apparatus of the present invention.

FIG. 5 is a schematic view illustrating an embodiment of the image forming apparatus of the present invention, wherein the electrostatic latent image bearer (electrophotographic photoreceptor) of the present invention is used. The image forming apparatus includes a drum-shaped photoreceptor 10, a discharge lamp 2, a charger 3, an eraser 4, an imagewise light irradiator 5, a developing unit 6, a pre-transfer charger 7, a resist roller 8, a transfer charger 110, a separation charger 111, a pre-cleaning charger 113, a cleaning brush 114 and a cleaning blade 115.

The photoreceptor 10 has the shape of a drum, and may have the shape of a sheet or an endless belt. Known chargers such as a corotron, a scorotron, a solid state charger and a charging roller contacting the photoreceptor or being located close thereto with a gap tape or a step can be used.

The charging roller located close to a photoreceptor is less unevenly or poorly charged than the charging roller contacting the photoreceptor, and is free from maintenance. However, a high voltage has to be applied thereto, i.e., a large stress is applied to the surface thereof, resulting in noticeable abrasion of an outermost layer (a CTL or a protective layer) including a conventional polymer binder. Further, a DC voltage overlapped with an AC voltage is preferably applied to the charging roller located close to a photoreceptor because of unstably discharging with only a DC voltage, which causes uneven image density.

The electrostatic latent image bearer (photoreceptor) of the present invention is scarcely abraded with the charging roller and stably charged, and stably produces quality images even when repeatedly used for long periods because of reducing the residual potential of the irradiated parts and preventing production of blurred images. The transferer includes the above-mentioned charges, and a combination of the transfer charger 110 and the separation charger 111 as illustrated in FIG. 5 is preferably used.

Specific examples of light sources for use in an irradiator 5 and a discharge lamp 2 include general light-emitting materials such as fluorescent lamps, tungsten lamps, halogen lamps, mercury lamps, sodium lamps, LEDs, LDs, light sources using electroluminescence (EL), etc. In addition, in order to obtain light having a desired wave length range, filters such as sharp-cut filters, band pass filters, near-infrared cutting filters, dichroic filters, interference filters, color temperature converting filters, etc. can be used.

The above-mentioned light sources can be used for not only the process illustrated in FIG. 5, but also other processes such as a transfer process, a discharging process, a cleaning process, a pre-exposure process including light irradiation to the photoreceptor.

When a toner image formed on the photoreceptor 10 by a developing unit 6 is transferred onto a transfer sheet 9, all of the toner image is not transferred thereto, and a residual toner remains on the surface of the photoreceptor 10. The residual toner is removed therefrom by a cleaning brush 114, a cleaning blade 115 or their combination. Specific examples of the cleaning brush include known cleaning brushes such as a fur brush and a mag-fur brush.

Specific examples of the cleaning blade 115 include elastic bodies having a low friction coefficient, such as a urethane resin, a silicone resin, a fluorine-containing resin, a urethane elastomer, a silicone elastomer and a fluorine-containing elastomer. A heat-hardening urethane resin is preferably used, and the urethane elastomer is more preferably used in terms of abrasion resistance, ozone resistance and contamination resistance. The elastomer includes a rubber. The cleaning blade 115 preferably has a hardness of from 65 to 85°, specified in JIS-A, a thickness of from 0.8 to 3.0 mm and an extrusion of from 3 to 15 mm. Other conditions such as a contact pressure, a contact angle and a bury can be determined as desired.

The cleaning blade removes the toner well, however, gives mechanical stress to the surface of the photoreceptor, resulting in abrasion thereof. The electrophotographic photoreceptor of the present invention stably produces quality images even when used in an image forming apparatus using the cleaning blade because the protective layer thereof has high abrasion resistance.

The image forming apparatus of the present invention may include a lubricant applicator. A spherical toner advantageously used to produce high-quality images is known to be difficult to clean with a blade. Therefore, the contact pressure is increased or a urethane rubber blade having high hardness is used. These give a large stress to the surface of a photoreceptor. Although the electrophotographic photoreceptor of the present invention is scarcely abraded even with such blades, the blade vibrates or an edge thereof is abraded.

The lubricant applicator in the image forming apparatus of the present invention applies a lubricant to the surface of a photoreceptor to reduce the friction coefficient thereof against the cleaning blade for long periods.

Figure 6:
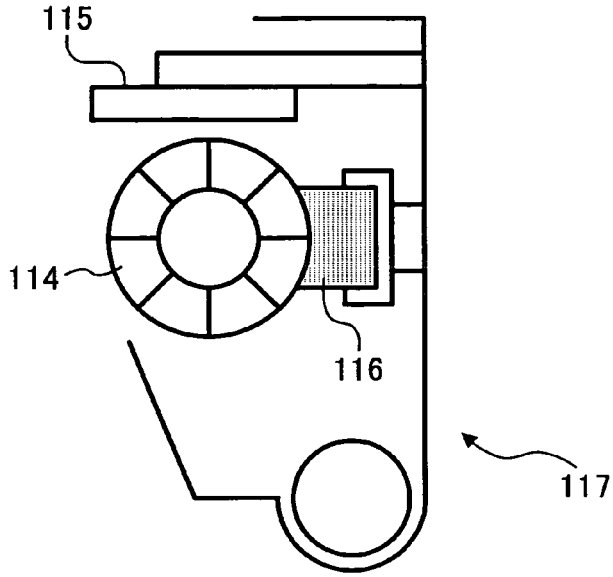
FIG. 6 is a schematic view illustrating an embodiment of the lubricant applicator used in the image forming apparatus of the present invention.

In FIG. 6, a solid lubricant 116 in the shape of a stick is pressed against a cleaning brush 114. When the cleaning brush 114 rotates, the cleaning brush scrapes the lubricant and applies the lubricant to the surface of a photoreceptor. The lubricant need not be a solid, may be a liquid, a powder or a paste provided that the lubricant can be applied to the surface thereof and satisfies the electrophotographic properties. Specific examples of the lubricant include metallic soaps such as zinc stearate, valium stearate, aluminum stearate and calcium stearate; waxes such as carnauba, lanolin and a haze wax; and lubricative oils such as a silicone oil, etc. The zinc stearate, aluminum stearate and calcium stearate are preferably used because of being easily formed into a stick and having high lubricating ability.

When the lubricant applicator is installed in a cleaning unit 117, although the apparatus and the layout therein can be simplified, the toner becomes difficult to recycle because the lubricant is mixed in the toner collected in a large amount and the cleanability of the brush deteriorates. In order to solve this problem, an applicator unit having a lubricant applicator may separately be installed from a cleaning unit. In that case, the applicator unit is preferably located downstream of the cleaning unit. Further, plural applicator units working at the same time or sequentially can increase the application efficiency of the lubricant and control the consumption thereof.

Figure 7:
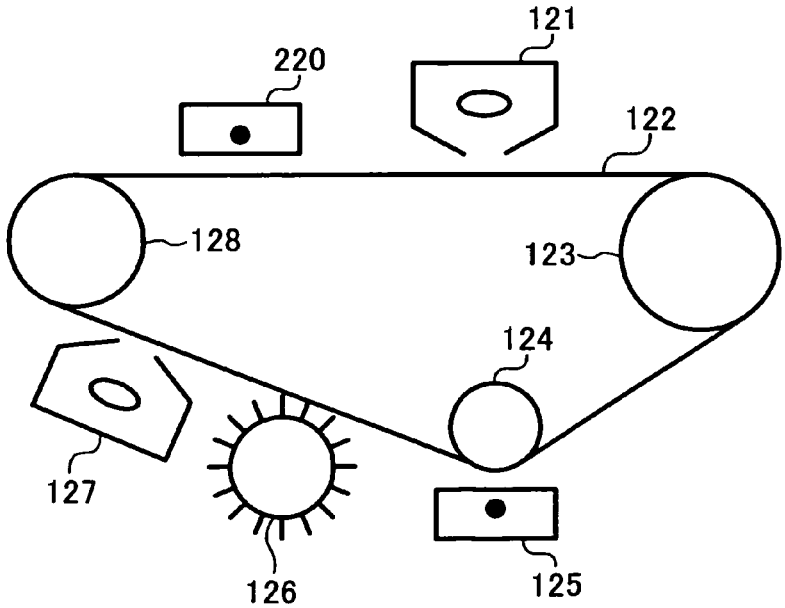
FIG. 7 is a schematic view illustrating another embodiment of the image forming apparatus of the present invention.

FIG. 7 is a schematic view illustrating another embodiment of the image forming apparatus of the present invention. In FIG. 7, a photoreceptor 122 is the electrostatic latent image bearer of the present invention, and is driven by a drive roller 123. Charging using a charger 220, imagewise exposure using an imagewise light irradiator 121, developing using a developing unit (not shown), transferring using a transfer charger 125, cleaning using a cleaning brush 126 and discharging using a discharging light source 127 are repeatedly performed.

Figure 8:
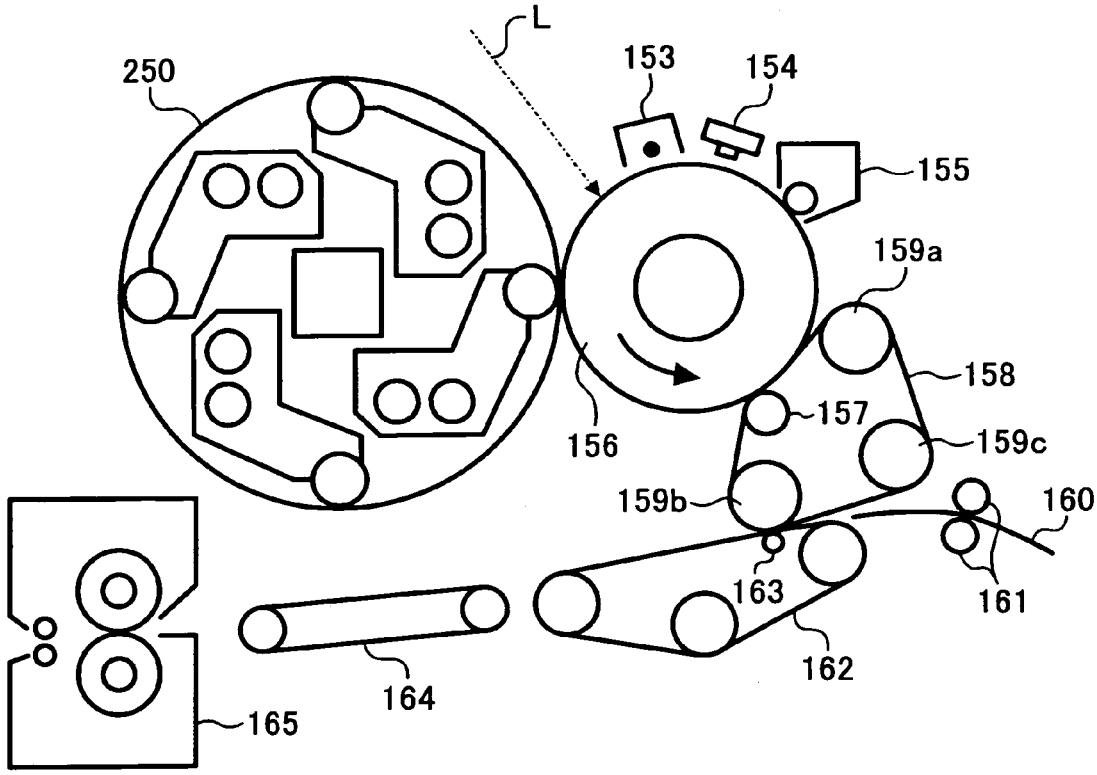
FIG. 8 is a schematic view illustrating a full-color image forming apparatus using the electrostatic latent image bearer of the present invention.

FIG. 8 is a schematic view illustrating a further embodiment of the image forming apparatus of the present invention. In FIG. 8, after a surface of a photoreceptor 156 as an image bearer is uniformly charged by a charger 153 using a corotron or a scorotron while rotated counterclockwise, the photoreceptor is scanned by a laser beam (L) emitted from a laser optical device (not shown) to bear an electrostatic latent image. Since the photoreceptor is scanned based on image information of each single color, i.e., yellow, magenta, cyan and black decomposed from a full-color image, an electrostatic latent image having a single color, i.e., yellow, magenta, cyan or black is formed on the photoreceptor 156. A revolver developing unit 250 is located on the left side of the photoreceptor 156. The revolver developing unit 250 has a yellow image developer, a magenta image developer, a cyan image developer and a black image developer in its rotating drum-shaped chassis, and rotates to sequentially locate each image developer in a developing position facing the photoreceptor 156. The yellow image developer, magenta image developer, cyan image developer and black image developer develop an electrostatic latent image by adhering a yellow toner, a magenta toner, a cyan toner and a black toner respectively thereto. An electrostatic latent image having each color is sequentially formed on the photoreceptor 156, and is sequentially developed by each image developer of the revolver developing unit 250 to form a yellow toner image, a magenta toner image, a cyan toner image and a black toner image.

An intermediate transfer unit is located in the downstream of rotation direction of the photoreceptor 156 from the developing position. The intermediate transfer unit endlessly rotates an intermediate transfer belt 158 stretched by a stretch roller 159*a*, an intermediate transfer bias roller 157 as a transferer, a second-transfer backup roller 159*b* and a belt drive roller 159*c* clockwise with a rotary drive thereof. The yellow toner image, magenta toner image, cyan toner image and black toner image are transferred to an intermediate transfer nip where the photoreceptor 156 and the intermediate transfer belt 158 contact each other. Then, the yellow toner image, magenta toner image, cyan toner image and black toner image are transferred onto the intermediate transfer belt 158 while affected by a bias from the intermediate transfer bias roller 157, and overlapped thereon to form a four-color overlapped toner image. The intermediate transfer method of overlapping toner images is an effective method for forming high-quality full color images because relative positions between the photoreceptor and the intermediate transferer can easily and precisely be fixed to prevent color drift.

A residual toner after transfer on a surface of the photoreceptor 156 which passed the intermediate transfer nip in accordance with the rotation is cleaned by a cleaning unit 155. The cleaning unit 155 cleans the residual toner after transfer with a cleaning roller a cleaning bias is applied to. However, the cleaning unit 155 may use a cleaning brush such as a fur brush and a mag-fur brush or a cleaning blade.

The surface of the photoreceptor 156, the residual toner on which after transfer is cleaned, is discharged by a discharging lamp 154. Fluorescent lamps, tungsten lamps, halogen lamps, mercury lamps, sodium lamps, light emitting diodes (LEDs), laser diodes (LDs), light sources using electroluminescence (EL) and the like are used for the discharging lamp 154. Filters such as sharp-cut filters, band pass filters, near-infrared cutting filters, dichroic filters, interference filters, color temperature converting filters and the like can be used to obtain light having a desired wavelength range.

Below the intermediate transfer unit in FIG. 8, a transfer unit including a transfer belt and various rollers such as a transfer bias roller and drive roller is located. On the left side of FIG. 8, a paper transfer belt 164 and a fixing unit 165 are located. The endless transfer belt may move up and down, and transports to a position not to contact the intermediate transfer belt 158 at least when a single-color (yellow) toner image, or a two or three-color toner image on the intermediate transfer belt 158 passes an opposite position to a paper transfer bias roller 163. Before an end of four-color toner image on the intermediate transfer belt 158 enters the opposite position to a paper transfer bias roller 163, the transfer unit moves to a position to contact the intermediate transfer belt 158 and forms a second transfer nip.

On the other hand, a resist roller 161 sandwiching a transfer paper 160 fed from a paper feeding cassette (not shown) between two rollers feeds the transfer paper 160 to the second transfer nip in time for overlapping the transfer paper 160 on the four-color overlapped toner image on the intermediate transfer belt 158. The four-color overlapped toner image on the intermediate transfer belt 158 is secondly transferred onto the transfer paper 160 at a time in the second transfer nip with a second transfer bias from a paper transfer bias roller 163. This second transfer forms a full-color image on the transfer paper 160.

The transfer paper 160 a full-color image is formed on is fed to the paper transfer belt 164 by a transfer belt 162. The paper transfer belt 164 feeds the transfer paper 160 from the transfer unit to a fixer 165. The fixer 165 transfers the transfer paper 160 while passing the transfer paper 160 through a fixing nip formed of a contact between a heating roller and a backup roller. The full-color image on the transfer paper 160 is fixed thereon with a heat from the heating roller and a pressure in the fixing nip.

A bias is applied to the transfer belt 162 and paper transfer belt 164 to draw the transfer paper 160 thereon although not shown. A paper discharger discharging the transfer paper 160, and three dischargers discharging each belt, i.e., the intermediate transfer belt 158, transfer belt 162 and paper transfer belt 164 are arranged. The intermediate transfer unit is also equipped with a belt cleaning unit similar to the drum cleaning unit 155, which cleans a residual toner on the intermediate transfer belt 158 after transfer.

Figure 9:
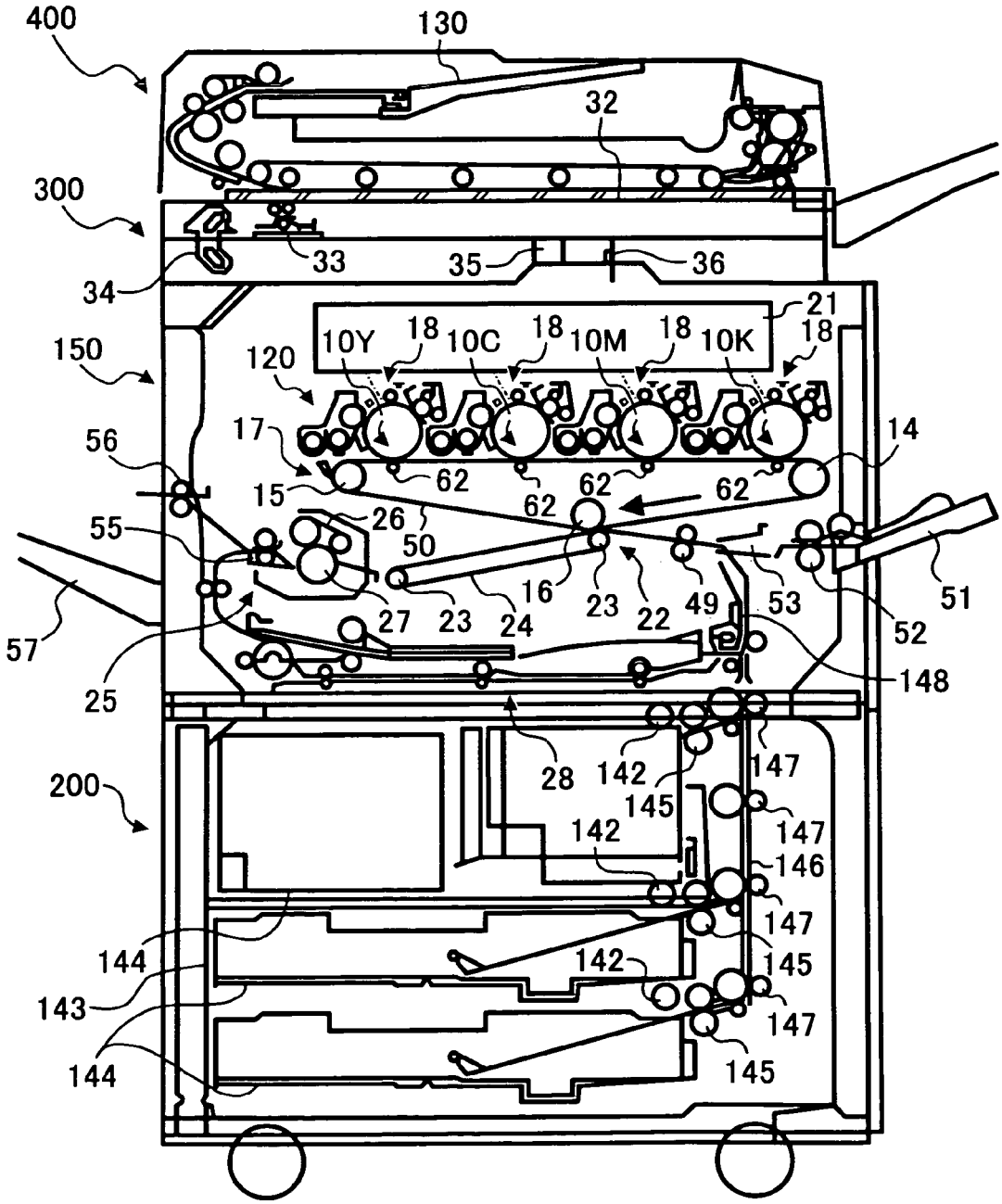
FIG. 9 is a schematic view illustrating an embodiment of the tandem image forming apparatus of the present invention.

FIG. 9 is a schematic view illustrating a tandem full-color image forming apparatus of the present invention. The tandem image forming apparatus 100 includes a duplicator 150, a paper feeding table 200, a scanner 300 and an automatic document feeder (ADF) 400.

The duplicator 150 includes an intermediate transferer 50 having the shape of an endless belt. The intermediate transferer 50 is suspended by three suspension rollers 14, 15 and 16 and rotatable in a clockwise direction. On the left of the suspension roller 15, an intermediate transferer cleaner 17 is located to remove a residual toner on an intermediate transferer 50 after an image is transferred. Above the intermediate transferer 50, four image forming units 18 for yellow, cyan, magenta and black colors are located in line from left to right along a transport direction of the intermediate transferer 50 to form a tandem image forming developer 120. Above the tandem color image developer 120, an irradiator 21 is located. On the opposite side of the tandem color image developer 120 across the intermediate transferer 50, a second transferer 22 is located. The second transferer 22 includes a an endless second transfer belt 24 and two rollers 23 suspending the endless second transfer belt 24, and is pressed against the suspension roller 16 across the intermediate transferer 50 and transfers an image thereon onto a sheet. Beside the second transferer 22, a fixer 25 fixing a transferred image on the sheet is located. The fixer 25 includes an endless belt 26 and a pressure roller 27 pressed against the belt. Below the second transferer 22 and the fixer 25, a sheet reverser 28 reversing the sheet to form an image on both sides thereof is located in the tandem color image forming apparatus 100.

Next, full-color image formation using a tandem image developer 120 will be explained. An original is set on a table 130 of the ADF 400 to make a copy, or on a contact glass 32 of the scanner 300 and pressed with the ADF 400.

When a start switch (not shown) is put on, a first scanner 33 and a second scanner 34 scans the original after the original set on the table 30 of the ADF 400 is fed onto the contact glass 32 of the scanner 300, or immediately when the original set thereon. The first scanner 33 emits light to the original and reflects reflected light therefrom to the second scanner 34. The second scanner further reflects the reflected light to a reading sensor 36 through an imaging lens 35 to read the color original (color image) as image information of black, yellow, magenta and cyan.

Figure 10:
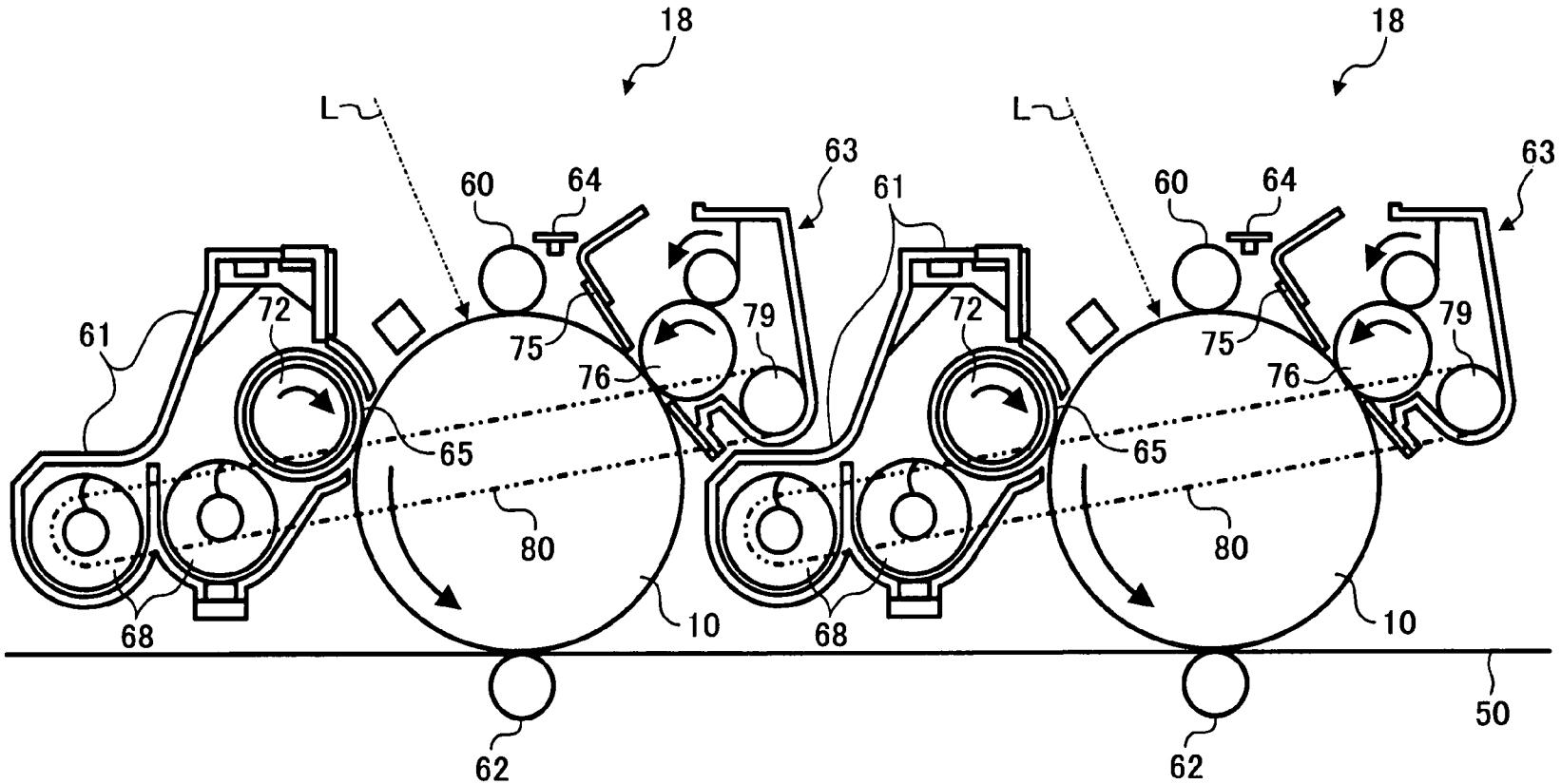
FIG. 10 is a schematic enlarged view illustrating a part of the image forming apparatus in FIG. 9.

The black, yellow, magenta and cyan image information are transmitted to each image forming units 18, i.e., a black image forming unit, a yellow image forming unit, a magenta image forming unit and a cyan image forming unit in the tandem image developer 120 respectively, and the respective image forming units form a black toner image, a yellow toner image, a magenta toner image and a cyan toner image. Namely, each of the image forming units 18 in the tandem image developer 120 includes, as shown in FIG. 10, a photoreceptor 10, i.e., a photoreceptor for black 10K, a photoreceptor for yellow 10Y, a photoreceptor for magenta 10M and a photoreceptor for cyan 10C; a charger 60 uniformly charging the photoreceptor; an irradiator irradiating the photoreceptor with imagewise light (L in FIG. 10) based on each color image information to form an electrostatic latent image thereon; an image developer 61 developing the electrostatic latent image with each color toner, i.e., a black toner, a yellow toner, a magenta toner and a cyan toner to form a toner image thereon; a transfer charger 62 transferring the toner image onto an intermediate transferer 50; a photoreceptor cleaner 63; and a discharger 64. When a start switch (not shown) is put on, a drive motor (not shown) rotates one of the suspension rollers 14, 15 and 16 such that the other two rollers are driven to rotate, to rotate the intermediate transferer 50. At the same time, each of the image forming units 18 rotates a photoreceptor 10 and forms a single-colored image, i.e., a black image (K), a yellow image (Y), a magenta image (M) and cyan image (C) on each photoreceptor 10K, 10Y, 10M and 10C. The single-colored images are sequentially transferred (first transfer) onto the intermediate transferer 50 to form a full-color image thereon.

Each color toner being mixed with a carrier is in the image developer and stirred with a stirring screw 68 to be charged. The charged carrier and toner are held by a rotating magnet roller 72 like ears to form a magnetic brush 65. A part of the toner forming the magnetic brush 65 is electrostatically attracted to the surface of the photoreceptor 10 to form a toner visual image thereon.

A cleaning unit 63 cleaning a residual toner after transfer is located downstream of the transfer process. In FIG. 10, the cleaning unit 63 includes a brush cleaner 76 and a cleaning blade 75. The cleaning blade 75 is located in the counter direction against the traveling direction of the surface of the photoreceptor to collect the residual toner after transfer.

The collected toner can be lead to the image developer again with a recycler. In FIG. 10, the toner collected by the cleaning unit is lead by a transfer screw 79 and a recycle route 80 to the image developer 61.

On the other hand, when start switch (not shown) is put on, one of paper feeding rollers 142 of paper feeding table 200 is selectively rotated to take a sheet out of one of multiple-stage paper cassettes 144 in a paper bank 143. A separation roller 145 separates sheets one by one and feed the sheet into a paper feeding route 146, and a feeding roller 147 feeds the sheet into a paper feeding route 148 to be stopped against a resist roller 49. Alternatively, a paper feeding roller 150 is rotated to take a sheet out of a manual feeding tray 51, and a separation roller 52 separates sheets one by one and feed the sheet into a paper feeding route 53 to be stopped against the resist roller 49. The resist roller 49 is typically earthed, and may be biased to remove a paper dust from the sheet.

Then, in timing with a synthesized full-color image on the intermediate transferer 50, the resist roller 49 is rotated to feed the sheet between the intermediate transferer 50 and the second transferer 22, and the second transferer transfers (second transfer) the full-color image onto the sheet. The intermediate transferer 50 after transferring an image is cleaned by the intermediate transferer cleaner 17 to remove a residual toner thereon after the image is transferred.

The sheet the full-color image is transferred on is fed by the second transferer 22 to the fixer 25. The fixer 25 fixes the image thereon upon application of heat and pressure, and the sheet is discharged by a discharge roller 56 onto a catch tray 57 through a switch-over click 55. Alternatively, the switch-over click 55 feeds the sheet into the sheet reverser 28 reversing the sheet to a transfer position again to form an image on the back side of the sheet, and then the sheet is discharged by the discharge roller 56 onto the catch tray 57.

The tandem method can produce images much faster than the revolver method because each color is developed in parallel. The printer in FIG. 9 uses an intermediate transfer method, and can stably and repeatedly produce high-quality full color images with less color drift at a very high speed for long periods when using the electrophotographic photoreceptor of the present invention.

The process cartridge of the present invention includes at least an electrostatic latent image bearer bearing an electrostatic latent image and an image developer developing the electrostatic latent image with a developer to form a visible image, and optional other means.

The image developer includes at least a developer container containing the toner or developer of the present invention and a developer bearer bearing the toner or developer contained in the container, and further may include a layer thickness regulator regulating a layer thickness of the toner.

Figure 11:
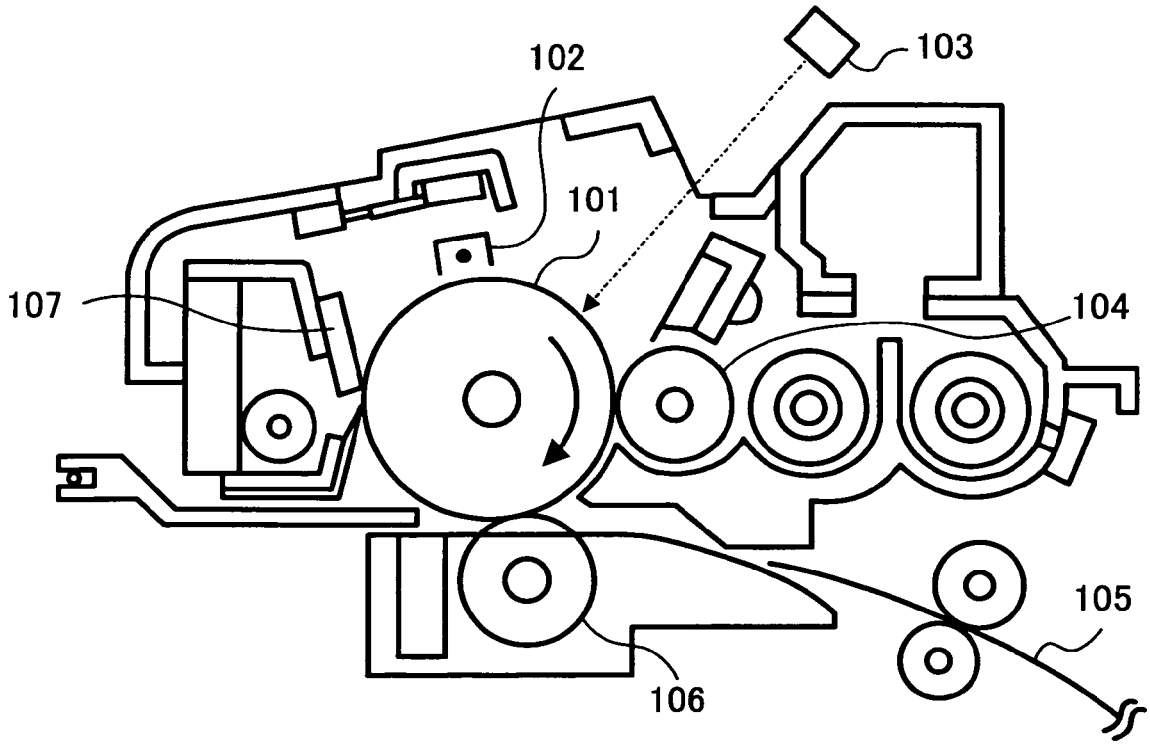
FIG. 11 is a schematic view illustrating an embodiment of the process cartridge of the present invention.

The process cartridge includes, as shown in FIG. 11, a photoreceptor 101 and at least one of a charger 102, an irradiator 103, an image developer 104, a cleaner 107 and other means. Numeral 105 is a recording medium and 106 is a transfer roller. The photoreceptor 101 is the electrostatic latent image bearer of the present invention. The an irradiator 103 uses a light source capable of writing a high-resolution electrostatic latent image. The charger 102 may be any conventional charger.

The image forming apparatus of the present invention may include the electrostatic latent image bearer and at least one of components such as an image developer and a cleaner as a process cartridge in a body, which is detachable therefrom. Alternatively, a process cartridge including the electrostatic latent image bearer and at least one of a charger, an irradiator, an image developer, a transferer or separator, and a cleaner may be detachable from the image forming apparatus through a guide rail or the like.

Since the electrostatic latent image bearer and other components can easily be replaced in a short time when included in a process cartridge, the maintenance of the image forming apparatus can be performed in a shorter time, which leads to cost reduction. In addition, since the electrostatic latent image bearer and other components are in a body, the preciseness of the relative positions thereof is improved.

Materials and methods of preparing toners for use in the image forming apparatus of the present invention are not particularly limited, and the toner can be prepared by pulverization and classification methods; and suspension polymerization methods, emulsification polymerization methods and polymer suspension methods, etc. which are emulsifying, suspending or agglutinating an oil phase in an aqueous medium to form toner particles.

The pulverization method includes melting, kneading, pulverizing and classifying toner constituents to form toner particles. A mechanical force may be applied to the toner particles to have an average circularity of from 0.97 to 1.0. A HYBRIDIZER or a MECHANOFUSION can apply the mechanical force thereto.

The suspension polymerization methods include dispersing a colorant, a release agent, etc. in an oil-soluble polymerization initiator and a polymerizing monomer to prepare a dispersion; and emulsifying the dispersion in an aqueous medium including a surfactant, a solid dispersant, etc. by an emulsification method mentioned later. After polymerized, a wet treatment applying an inorganic particulate material to the resultant toner particles is performed. Before the wet treatment, the excessive surfactant is preferably washed from the toner particles.

Specific examples of the polymerizing monomer include acids such as an acrylic acid, a methacrylic acid, an α-cyanoacrylic acid, an α-cyanomethacrylic acids an itaconic acid, a crotonic acid, a fumaric acid and a maleic acid or a maleic acid anhydride; acrylates or methacrylates having an amino group such as acrylamide, methacrylamide, diacetoneacrylamide or their methylol compounds, vinylpyridine, vinylpyrrolidone, vinylimidazole, ethyleneimine and dimethylaminoethyl methacrylate. These can induce a functional group to the surface of the toner particles. An acid radical or basic group as a dispersant is absorbed to the surface of the toner particles to induce a functional group thereto.

The emulsification polymerization methods include emulsifying a water-soluble polymerization initiator and a polymerizing monomer in water with a surfactant to prepare a latex by conventional emulsification polymerization methods. A dispersion wherein a colorant and a release agent are dispersed is separately prepared, and the dispersion is mixed with the latex. The mixture is agglutinated to have a toner size and fusion-bonded to prepare toner particles. Then, a wet treatment applying an inorganic particulate material to the resultant toner particles is performed. Specific examples of the polymerizing monomer include the materials mentioned in the suspension polymerization methods.

The toner is preferably granulated by emulsifying or dispersing a solution or a dispersion including toner constituents in an aqueous medium because of high selectivity of resins; high low-temperature fixability and easiness of controlling a particle diameter, a particle diameter distribution and a shape. The solution including the toner constituents is a solvent wherein the toner constituents are dissolved, and the dispersion including the toner constituents is a solvent wherein the toner constituents are dispersed.

Specific examples of the toner constituents include at least an adhesive base material formed from a reaction among a compound including a group having an active hydrogen, a polymer reactable therewith, a binder resin, a release agent and a colorant; and further, optionally include a particulate resin, a charge controlling agent, etc.

The adhesive base material has adhesiveness to a recording medium such as a paper, includes at least an adhesive polymer formed from a reaction between the compound including a group having an active hydrogen and the polymer reactable therewith un an aqueous medium, and may include a binder resin optionally selected from conventional resins.

The adhesive base material preferably has a weight-average molecular weight not less than 1,000, more preferably from 2,000 to 10,000,000, and much more preferably from 3,000 to 1,000,000. When less than 1,000, the hot offset resistance of the resultant toner occasionally deteriorates.

The adhesive base material preferably has a temperature (TG') not less than 100° C., and more preferably of from 110 to 200° C. at which a storage modulus thereof is 10,000 dyne/cm$^2$ at a measuring frequency of 20 Hz. When less than 100° C., the hot offset resistance of the resultant toner deteriorates.

The toner binder resin preferably has a temperature (Tη) not greater than 180° C., and more preferably of from 90 to 160° C. at which a viscosity is 1,000 poise. When greater than 180° C., the low-temperature fixability of the resultant toner deteriorates.

Therefore, TG' is preferably higher than Tη in terms of the low-temperature fixability and hot offset resistance of the resultant toner. Namely, a difference between TG' and Tη (TG'−Tη) is preferably not less than 0° C., more preferably not less than 10° C., and furthermore preferably not less than 20° C. The larger, the better.

In terms of the thermostable preservability and low-temperature fixability of the resultant toner, the difference between TG' and Tη (TG'−Tη) is preferably from 0 to 100° C., more preferably from 10 to 90° C., and most preferably from 20 to 80° C.

Specific examples of the adhesive base material include polyester resins. Specific examples of the polyester resins include urea-modified polyester resins.

The urea-modified polyester resins are formed from a reaction between amines (B) as the compound including group having an active hydrogen and a polyester prepolymer including an isocyanate group (A) as the polymer reactable therewith in the aqueous medium.

The urea-modified polyester resins may include a urethane bonding as well as a urea bonding. A molar ratio (urea/urethane) of the urea bonding to the urethane bonding is from 100/0 to 10/90, preferably from 80/20 to 20/80 and more preferably from 60/40 to 30/70. When the urea bonding has a molar ratio less than 10%, hot offset resistance of the resultant toner deteriorates.

Specific examples of the urea-modified polyester resins include (1) a mixture of a urea-modified polyester prepolymer with isophoronediamine, which is formed from a reacting a polycondensate of an adduct of bisphenol A with 2 moles of ethyleneoxide and an isophthalic acid with isophoronediisocyanate; and a polycondensate of an adduct of bisphenol A with 2 moles of ethyleneoxide and an isophthalic acid, (2) a mixture of a urea-modified polyester prepolymer with isophoronediamine, which is formed from a reacting a polycondensate of an adduct of bisphenol A with 2 moles of ethyleneoxide and an isophthalic acid with isophoronediisocyanate; and a polycondensate of an adduct of bisphenol A with 2 moles of ethyleneoxide and a terephthalic acid, (3) a mixture of a urea-modified polyester prepolymer with isophoronediamine, which is formed from a reacting a polycondensate of an adduct of bisphenol A with 2 moles of ethyleneoxide/an adduct of bisphenol A with 2 moles of propyleneoxide and an terephthalic acid with isophoronediisocyanate; and a polycondensate of an adduct of bisphenol A with 2 moles of ethyleneoxide/an adduct of bisphenol A with 2 moles of propyleneoxide and a terephthalic acid, (4) a mixture of a urea-modified polyester prepolymer with isophoronediamine, which is formed from a reacting a polycondensate of an adduct of bisphenol A with 2 moles of ethyleneoxide/an adduct of bisphenol A with 2 moles of propyleneoxide and an terephthalic acid with isophoronediisocyanate; and a polycondensate of an adduct of bisphenol A with 2 moles of propyleneoxide and a terephthalic acid, (5) a mixture of a urea-modified polyester prepolymer with hexamethylenediamine, which is formed from a reacting a polycondensate of an adduct of bisphenol A with 2 moles of ethyleneoxide and an terephthalic acid with isophoronediisocyanate; and a polycondensate of an adduct of bisphenol A with 2 moles of ethyleneoxide and a terephthalic acid, (6) a mixture of a urea-modified polyester prepolymer with hexamethylenediamine, which is formed from a reacting a polycondensate of an adduct of bisphenol A with 2 moles of ethyleneoxide and an terephthalic acid with isophoronediisocyanate; and a polycondensate of an adduct of bisphenol A with 2 moles of ethyleneoxide/an adduct of bisphenol A with 2 moles of propyleneoxide and a terephthalic acid, (7) a mixture of a urea-modified polyester prepolymer with ethylenediamine, which is formed from a reacting a polycondensate of an adduct of bisphenol A with 2 moles of ethyleneoxide and an terephthalic acid with isophoronediisocyanate; and a polycondensate of an adduct of bisphenol A with 2 moles of ethyleneoxide and a terephthalic acid, (8) a mixture of a urea-modified polyester prepolymer with hexamethylenediamine, which is formed from a reacting a polycondensate of an adduct of bisphenol A with 2 moles of ethyleneoxide and an isophthalic acid with diphenylmethanediisocyanate; and a polycondensate of an adduct of bisphenol A with 2 moles of ethyleneoxide and an isophthalic acid, (9) a mixture of a urea-modified polyester prepolymer with hexamethylenediamine, which is formed from a reacting a polycondensate of an adduct of bisphenol A with 2 moles of ethyleneoxide/an adduct of bisphenol A with 2 moles of propyleneoxide and an terephthalic acid/dodecenylsuccinic acid anhydride with diphenylmethanediisocyanate; and a polycondensate of an adduct of bisphenol A with 2 moles of ethyleneoxide/an adduct of bisphenol A with 2 moles of propyleneoxide and a terephthalic acid, and (10) a mixture of a urea-modified polyester prepolymer with hexamethylenediamine, which is formed from a reacting a polycondensate of an adduct of bisphenol A with 2 moles of ethyleneoxide and an isophthalic acid with toluenediisocyanate; and a polycondensate of an adduct of bisphenol A with 2 moles of ethyleneoxide and an isophthalic acid.

The compound including a group having an active hydrogen performs as an elongator or a crosslinker when the polymer reactable therewith is subject to an elongation or crosslinking reaction in the aqueous medium.

The amines (B) is preferably used as the compound including a group having an active hydrogen include when the polymer reactable therewith is the polyester prepolymer including an isocyanate group (A) because of being polymerizable from an elongation or a crosslinking reaction with the polyester prepolymer including an isocyanate group (A).

Specific examples of the a group having an active hydrogen include hydroxyl groups such as an alcoholic hydroxyl group and a phenolic hydroxyl group, an amino group, a carboxyl group, a mercapto group, etc. These can be used alone or in combination. Among these, the alcoholic hydroxyl group is preferably used.

Specific examples of the amines (B) include diamines (B1), polyamines (B2) having three or more amino groups, amino alcohols (B3), amino mercaptans (B4), amino acids (B5) and blocked amines (B6) in which the amino groups in the amines (B1) to (B5) are blocked. These can be used alone or in combination. Among these, the diamine (B1), and a mixture of the diamine (B1) and a small amount of the polyamines (B2) having three or more amino groups are preferably used.

Specific examples of the diamines (B1) include aromatic diamines such as phenylene diamine, diethyltoluene diamine and 4,4'-diaminodiphenyl methane; alicyclic diamines such as 4,4'-diamino-3,3'-dimethyldicyclohexyl methane, diaminocyclohexane and isophoronediamine; aliphatic diamines such as ethylene diamine, tetramethylene diamine and hexamethylene diamine.

Specific examples of the polyamines (B2) having three or more amino groups include diethylene triamine, triethylene tetramine, etc.

Specific examples of the amino alcohols (B3) include ethanol amine, hydroxyethyl aniline, etc.

Specific examples of the amino mercaptan (B4) include aminoethyl mercaptan, aminopropyl mercaptan, etc.

Specific examples of the amino acids (B5) include amino propionic acid, amino caproic acid, etc.

Specific examples of the blocked amines (B6) include ketimine compounds which are prepared by reacting one of the amines (B1) to (B5) with a ketone such as acetone, methyl ethyl ketone and methyl isobutyl ketone; oxazoline compounds, etc.

A reaction terminator can be used to terminate the elongation or crosslinking reaction between the compound including a group having an active hydrogen and the polymer reactable therewith. The reaction terminator is preferably used to control the molecular weight of the adhesive base material. Specific examples of the reaction terminator include monoamines such as diethyle amine, dibutyl amine, butyl amine and lauryl amine, and blocked amines, i.e., ketimine compounds prepared by blocking the monoamines mentioned above.

A mixing ratio, i.e., a ratio [NCO]/[NHx] of the isocyanate group [NCO] in the prepolymer (A) to the amino group [NHx] in the amine (B) is preferably from 1/3 to 3/1, more preferably from 1/2 to 2/1, and even more preferably from 1/1.5 to 1.5/1.

When the mixing ratio ([NCO]/[NHx]) is less than 1/3, the low-temperature fixability of the resultant toner deteriorates. When greater than 3/1, the hot offset resistance thereof deteriorates.

The polymer reactable with the compound having a group including an active hydrogen (hereinafter referred to as a "prepolymer") is not particularly limited, and can be selected in accordance with the purpose, provided that the polymer at least has a site reactable with the compound having a group including an active hydrogen. Specific examples thereof include a polyol resins, a polyacrylic resin, a polyester resin, an epoxy resin, their derivatives, etc. These can be used alone or in combination. Among these resins, the polyester resin having high fluidity when melting and transparency is preferably used.

The site reactable with the compound having a group including an active hydrogen is not particularly limited, and can be selected in accordance with the purpose. Specific examples thereof include an isocyanate group, an epoxy group, a carboxylic acid group, an acid chloride group, etc. These can be used alone or in combination. Among these groups, the isocyanate group is preferably used.

Among the prepolymers, a polyester resin including a group formed by urea bonding (RMPE) is preferably used because of being capable of controlling the molecular weight of the polymer components, imparting oilless low-temperature fixability to a dry toner, and good releasability and fixability thereto even in an apparatus without a release oil applicator to a heating medium for fixing.

The group formed by urea bonding includes an isocyanate group, etc. When the group formed by urea bonding of the polyester resin including a group formed by urea bonding (RMPE) is an isocyanate group, the polyester prepolymer including an isocyanate group (A) is preferably used as the polyester resin including a group formed by urea bonding (RMPE).

The polyester prepolymer including an isocyanate group (A) is not particularly limited, and can be selected in accordance with the purpose. For example, the polyester prepolymers including an isocyanate group (A) can be prepared by reacting a polycondensation product of a polyol (PO) and a polycarboxylic acid (PC), i.e., a polyester resin having a group including an active hydrogen atom, with a polyisocyanate (PIC).

The polyol (PO) is not particularly limited, and can be selected in accordance with the purpose. For example, suitable polyols (PO) include diols (DIO), polyols (TO) having three or more hydroxyl groups, and mixtures of DIO and TO. These can be used alone or in combination. Preferably, diols (DIO) alone or mixtures of a diol (DIO) with a small amount of polyol (TO) are used.

Specific examples of the diol (DIO) include alkylene glycols, alkylene ether glycols, alicyclic diols, bisphenols, alkylene oxide adducts of alicyclic diols, alkylene oxide adducts of bisphenols, etc.

Specific examples of the alkylene glycols include ethylene glycol, 1,2-propylene glycol, 1,3-propylene glycol, 1,4-butanediol and 1,6-hexanediol. Specific examples of the alkylene ether glycols include diethylene glycol, triethylene glycol, dipropylene glycol, polyethylene glycol, polypropylene glycol and polytetramethylene ether glycol. Specific examples of the alicyclic diols include 1,4-cyclohexanedimethanol and hydrogenated bisphenol A. Specific examples of the bisphenols include bisphenol A, bisphenol F and bisphenol S. Specific examples of the alkylene oxide adducts of alicyclic diols include adducts of the alicyclic diols mentioned above with an alkylene oxide (e.g., ethylene oxide, propylene oxide and butylene oxide). Specific examples of the alkylene oxide adducts of bisphenols include adducts of the bisphenols mentioned above with an alkylene oxide (e.g., ethylene oxide, propylene oxide and butylene oxide).

Among these compounds, alkylene glycols having from 2 to 12 carbon atoms and adducts of bisphenols with an alkylene oxide are preferable. More preferably, adducts of bisphenols with an alkylene oxide, and mixtures of an adduct of bisphenols with an alkylene oxide and an alkylene glycol having from 2 to 12 carbon atoms are used.

Specific examples of the TO include multivalent aliphatic alcohol having 3 to 8 or more valences such as glycerin, trimethylolethane, trimethylolpropane, pentaerythritol and sorbitol; phenol having 3 or more valences such as trisphenol PA, phenolnovolak, cresolnovolak; and adducts of the above-mentioned polyphenol having 3 or more valences with an alkylene oxide such as ethylene oxide, propylene oxide and butylene oxide.

A mixing ratio (DIO/TO) of the DIO to the TO is preferably 100/0.01 to 10, and more preferably 100/0.01 to 1.

Specific examples of the polycarboxylic acids (PC) include dicarboxylic acids (DIC) and polycarboxylic acids having three or more carboxyl groups (TC). These can be used alone or in combination. The dicarboxylic acids (DIC) alone and a mixture of the dicarboxylic acids (DIC) and a small amount of the polycarboxylic acid having three or more carboxyl groups (TC) are preferably used.

Specific examples of the dicarboxylic acids (DIC) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acid having three or more (preferably from 3 to 8) hydroxyl groups (TC) include aromatic polycarboxylic acids having from 9 to 20 carbon atoms (e.g., trimellitic acid and pyromellitic acid).

Anhydrides or lower alkyl esters (e.g., methyl esters, ethyl esters or isopropyl esters) of the dicarboxylic acids (DIC), the polycarboxylic acids having three or more hydroxyl groups (TC) or their mixture can also be used as the polycarboxylic acid (PC). Specific examples of the lower alkyl esters include a methyl ester, an ethyl ester, an isopropyl ester, etc.

A mixing ratio (DIC/TC) of the DIC to the TC is preferably from 100/0.01 to 10, and more preferably from 100/0.01 to 1.

Suitable mixing ratio (i.e., the equivalence ratio [OH]/[COOH]) of the [OH] group of a polyol (PO) to the [COOH] group of a polycarboxylic acid (PC) is from2/1 to 1/1, preferably from 1.5/1 to 1/1 and more preferably from 1.3/1 to 1.02/1.

The polyester prepolymer including an isocyanate group (A) preferably includes the polyol (PO) in an amount of from 0.5 to 40% by weight, more preferably from 1 to 30% by weight, and even more preferably from 2 to 20% by weight. When less than 0.5% by weight, the hot offset resistance of the resultant toner deteriorates, which is difficult to have both thermostable preservability and low-temperature fixability. When greater than 40% by weight, the low-temperature fixability thereof deteriorates.

Specific examples of the polyisocyanates (PIC) include aliphatic polyisocyanates such as tetramethylenediisocyanate, hexamethylenediisocyanate, 2,6-diisocyanatemethylcaproate, octamethylenediisocyanate, decamethylenediisocyanate, dodecamethylenediisocyanate, tetradecamethylenediisocyanate and trimethylhexanediisocyanate; alicyclic polyisocyanates such as isophoronediisocyanate and cyclohexylmethanediisocyanate; aromatic diisocianates such as tolylene diisocyanate, diphenylmethane diisocyanate, 1,5-naphthylene diisocyanate, diphenylene-4,4'-diisocyanate, 4,4'-diisocyanate-3,3-dimethyl diphenyl, 3-methyldiphenylmethane-4,4'-diisocyanate and diphenylether-4,4'-diisocyanate; aromatic aliphatic diisocyanates such as $\alpha,\alpha,\alpha',\alpha'$-tetramethylxylylenediisocyanate; isocyanurates such as tris-isocyanatealkyl-isocyanurate and triisocyanatecycloalkyl-isocyanurate; blocked polyisocyanates in which the polyisocyanates mentioned above are blocked with phenol derivatives, oximes or caprolactams; etc.

These compounds can be used alone or in combination.

Suitable mixing ratio (i.e., the equivalence ratio [NCO]/[OH]) of the [NCO] group of the polyisocyanate (PIC) to the [OH] group of the polyester resin having a group including an active hydrogen (such as a polyester resin including a hydroxyl group) is from 5/1 to 1/1, preferably from 4/1 to 1.2/1 and more preferably from 2.5/1 to 1.5/1.

When greater than 5/1, the low-temperature fixability of the resultant toner deteriorates. When less than 1/1, the offset resistance thereof deteriorates.

The polyester prepolymer including an isocyanate group (A) preferably includes the polyisocyanate (PIC) in an amount of from 0.5 to 40% by weight, more preferably from 1 to 30% by weight, and even more preferably from 2 to 20% by weight.

When less than 0.5% by weight, the hot offset resistance of the resultant toner deteriorates, which is difficult to have both thermostable preservability and low-temperature fixability. When greater than 40% by weight, the low-temperature fixability thereof deteriorates.

An average number of the isocyanate group included in the polyester prepolymer including an isocyanate group (A) per molecule is preferably not less than 1, more preferably from 1.2 to 5, and even more preferably from 1.5 to 4.

When less than 1, the polyester resin including a group formed by urea bonding (RMPE) has a lower molecular weight, and the hot offset resistance of the resultant toner deteriorates.

The tetrahydrofuran (THF) soluble components of the polymer reactable with the compound having a group including an active hydrogen preferably have a weight-average molecular weight (Mw) of from 1,000 to 30,000, and more preferably from 1,500 to 15,000 in a gel permeation chromatography. When less than 1,000, the thermostable preservability of the resultant toner deteriorates. When greater than 30,000, the low-temperature fixability thereof deteriorates.

The molecular weight is measured by GPC (gel permeation chromatography) as follows. A column is stabilized in a heat chamber having a temperature of 40° C.; THF is put into the column at a speed of 1 ml/min as a solvent; 50 to 200 μl of a THF liquid-solution of a resin, having a sample concentration of from 0.05 to 0.6% by weight, is put into the column; and a molecular weight distribution of the sample is determined by using a calibration curve which is previously prepared using several polystyrene standard samples having a single distribution peak, and which shows the relationship between a count number and the molecular weight. As the standard polystyrene samples for making the calibration curve, for example, the samples having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $48\times10^6$ from Pressure Chemical Co. or Tosoh Corporation are used. It is preferable to use at least 10 standard polystyrene samples. In addition, an RI (refraction index) detector is used as the detector.

Specific examples of the binder resins include a polyester resin. Particularly an unmodified polyester resin is preferably used. The unmodified polyester resin included in a toner improves the low-temperature fixability thereof and glossiness of images produced thereby.

The unmodified polyester resin includes the examples of the polyester resin including a group formed by urea bonding (RMPE), i.e., the polycondensated products between the PO and PC. It is preferable that the unmodified polyester resin is partially compatible with the polyester resin including a group formed by urea bonding, i.e., these have a compatible similar structure because the resultant toner has good low-temperature fixability and hot offset resistance.

The tetrahydrofuran (THF) soluble components of the unmodified polyester resin preferably have a weight-average molecular weight (Mw) of from 1,000 to 30,000, and more preferably from 1,500 to 15,000 in a gel permeation chromatography. When less than 1,000, the thermostable preservability of the resultant toner deteriorates, and therefore the content of the unmodified polyester resin having weight-average molecular weight (Mw) less than 1,000 needs to be 8 to 28% by weigh. When greater than 30,000, the low-temperature fixability thereof deteriorates.

The unmodified polyester resin preferably has a glass transition temperature of from 30 to 70° C., more preferably from 35 to 60° C., and even more preferably from 35 to 50° C. When less than 30° C., the thermostable preservability of the resultant toner deteriorates. When greater than 70° C., the low-temperature fixability thereof is insufficient.

The unmodified polyester resin preferably has a hydroxyl value not less than 5 KOH mg/g, more preferably from 10 to 120 KOH mg/g, and even more preferably from 20 to 80 KOH mg/g. When less than 5 KOH mg/g, the resultant toner is difficult to have both thermostable preservability and low-temperature fixability.

The unmodified polyester resin preferably has an acid value of from 1.0 to 50.0 KOH mg/g, more preferably from 1.0 to 45.0 KOH mg/g, and furthermore preferably from 15.0 to 45.0 KOH mg/g. The resultant toner having such an acid value typically tends to be negatively charged.

A mixing ratio (polymer/PE) by weight of the polymer reactable with the compound having an active hydrogen such as the polyester resin including a group formed by urea bonding urea bonding (RMPE) to the unmodified polyester resin (PE) is preferably from 5/95 to 20/80, and more preferably from 10/90 to 25/75.

When the mixing ratio by weight of the PE is greater than 95, the hot offset resistance of the resultant toner deteriorates. When less than 20, the glossiness thereof deteriorates.

The content of the PE is preferably from 50 to 100% by weight, more preferably from 70 to 95%, and much more preferably from 80 to 90% by weight based on total weight of the binder resin. When less than 50% by weight, the low-temperature fixability and the glossiness of the resultant toner deteriorate. Specific examples of the colorants for use in the present invention include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination. The toner particles preferably include the colorant in an amount of from 1 to 15% by weight, and more preferably from 3 to 10% by weight.

When less than 1% by weight, the resultant toner cannot produce images with high image density. When greater than 15 5 by weight, problems in that the resultant toner cannot produce images with high image density and has poor electrostatic properties due to defective dispersion of the colorant in the toner occur.

Masterbatches, which are complexes of a colorant with a resin, can be used as the colorant of the toner of the present invention. Specific examples of the resins for use as the binder resin of the master batch include a polymer of styrene or a styrene derivative, a styrene copolymer, polymethyl methacrylate, polybutylmethacrylate, polyvinyl chloride, polyvinyl acetate, polyethylene, polypropylene, polyester, an epoxy resin, an epoxy polyol resin, a polyurethane resin, a polyamide resin, a polyvinyl butyral resin, an acrylic resin, a rosin, a modified rosin, a terpene resin, an aliphatic or an alicyclic hydrocarbon resin, an aromatic petroleum resin, a chlorinated paraffin, a paraffin, etc. These can be used alone or in combination.

Specific examples of the polymer of styrene or a styrene derivative include polystyrene, poly-p-chlorostyrene and polyvinyltoluene. Specific examples of the styrene copolymer include a styrene-p-chlorostyrene copolymer, a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-methyl α-chloromethacrylate copolymer, a styrene-acrylonitrile copolymer, a styrene-vinyl methyl ketone copolymer, a styrene-butadiene copolymer, a styrene-isoprene copolymer, a styrene-acrylonitrile-indene copolymer, a styrene-maleic acid copolymer, a styrene-maleic acid ester copolymer, etc.

The masterbatches can be prepared by mixing one or more of the resins as mentioned above and one or more of the colorants as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed can be preferably used because the resultant wet cake can be used as it is without being dried. When performing the mixing and kneading process, dispersing devices capable of applying a high shearing force such as three roll mills can be preferably used.

Specific examples of the other constituents include a release agent, a charge controlling agent, a fluidity improver, a cleanability improver, a magnetic-material, etc.

Specific examples of the release agent include waxes, e.g., polyolefin waxes such as polyethylene wax and polypropylene wax; long chain carbon hydrides such as paraffin wax and sasol wax; and waxes including carbonyl groups. Among these waxes, the waxes including carbonyl groups are preferably used. Specific examples thereof include polyesteralkanate such as carnauba wax, montan wax, trimethylolpropanetribehenate, pentaelislitholtetrabehenate, pentaelislitholdiacetatedibehenate, glycerinetribehenate and 1,18-octadecanedioldistearate; polyalkanolesters such as tristearyltrimellitate and distearylmaleate; polyamidealkanate such as ethylenediaminebehenylamide; polyalkylamide such as tristearylamidetrimellitate; and dialkylketone such as distearylketone. Among these waxes including a carbonyl group, polyesteralkanate is preferably used.

The wax preferably has a melting point of from 40 to 160° C., more preferably of from 50 to 120° C., and much more preferably of from 60 to 90° C. A wax having a melting point less than 40° C. has an adverse effect on its high temperature preservability, and a wax having a melting point greater than 160° C. tends to cause cold offset of the resultant toner when fixed at a low temperature.

In addition, the wax preferably has a melting viscosity of from 5 to 1,000 cps, and more preferably of from 10 to 1,000 cps when measured at a temperature higher than the melting point by 20° C. A wax having a melting viscosity greater than 1,000 cps makes it difficult to improve hot offset resistance and low temperature fixability of the resultant toner.

The content of the wax in a toner is preferably from 0 to 40% by weight, and more preferably from 3 to 30% by weight. When greater than 40% by weight, the fluidity of the toner deteriorates.

Known charge controlling agents can be used. However, colorless or white charge controlling agents are preferably used because colored charge controlling agents change the color tone of a toner. Specific examples thereof include triphenylmethane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and its compounds, tungsten and its compounds, fluorine-containing activators, metal salts of salicylic acid, metal salts of salicylic acid derivatives, etc. These can be used alone or in combination.

Specific examples of marketed charge controlling agents include BONTRON P-51 (quaternary ammonium salt), BONTRON E-82 (metal complex of oxynaphthoic acid), BONTRONE-84 (metal complex of salicylic acid), and BONTRON E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and COPY CHARGE NX VP434 (quaternary ammonium salt), which are manufactured by Hoechst AG; LRA-901, and LR-147 (boron complex), which are manufactured by Japan Carlit Co., Ltd.; quinacridone, azo pigments, and polymers having a functional group such as a sulfonate group, a carboxyl group, a quaternary ammonium group, etc.

The charge controlling agent can be included in the toner by a method in which a mixture of the charge controlling agent and the masterbatch, which have been melted and kneaded, is dissolved or dispersed in a solvent and the resultant solution or dispersion is dispersed in an aqueous medium to prepare a toner dispersion or a method in which the charge controlling agent is dissolved or dispersed together with other toner constituents to prepare a toner constituent mixture liquid and the mixture liquid is dispersed in an aqueous medium to prepare a toner dispersion. Alternatively, the charge controlling agent can be fixed on a surface of the toner after toner particles are prepared.

The content of the charge controlling agent in the toner is determined depending on the variables such as choice of binder resin, presence of additives, and dispersion method. In general, the content of the charge controlling agent is preferably from 0.1 to 10 parts by weight, and more preferably from 0.2 to 5 parts by weight, per 100 parts by weight of the binder resin included in the toner. When the content is too low, a good charge property cannot be imparted to the toner. When the content is too high, the charge quantity of the toner excessively increases, and thereby the electrostatic attraction between the developing roller and the toner increases, resulting in deterioration of fluidity and decrease of image density.

Any known thermoplastic or thermosetting resins which can form a dispersion in an aqueous medium can be used as the particulate resin. Specific examples thereof include a vinyl resin, a polyurethane resins, an epoxy resins, a polyester resin, a polyamide resin, a polyimide resin, a silicone resin, a phenolic resin, a melamine resin, a urea resin, an aniline resin, an ionomer resin, a polycarbonate resins, etc.

These resins can be used alone or in combination. Among these resins, at least one of the vinyl resins, the polyurethane resins, the epoxy resins and the polyester resins is preferably used because an aqueous dispersion including a microscopic spherical particulate resin can easily be prepared with the resin.

Specific examples of the vinyl resins include homopolymerized or copolymerized polymers such as styrene-(metha) esteracrylate resins, styrene-butadiene copolymers, (metha) acrylic acid-esteracrylate polymers, styrene-acrylonitrile copolymers, styrene-maleic acid anhydride copolymers and styrene-(metha)acrylic acid copolymers.

As the particulate resin, a copolymer including a monomer having at least two unsaturated groups can also be used.

The monomer having at least two unsaturated groups is not particularly limited, and can be selected in accordance with the purpose. Specific examples thereof include a sodium salt of a sulfate ester with an additive of ethylene oxide methacrylate (ELEMINOL RS-30 from Sanyo Chemical Industries, Ltd.), divinylbenzene, 1,6-hexanediolacrylate, etc.

The particulate resin can be prepared by any known polymerization methods, however, preferably prepared in the form of an aqueous dispersion thereof. The aqueous dispersion thereof can be prepared by the following methods:

(1) a method of directly preparing an aqueous dispersion of a vinyl resin from a vinyl monomer by a suspension polymerization method, an emulsification polymerization method, a seed polymerization method or a dispersion polymerization method;

(2) a method of preparing an aqueous dispersion of polyaddition or polycondensation resins such as a polyester resin, a polyurethane resin and an epoxy resin by dispersing a precursor (such as a monomer and an oligomer) or a solution thereof in an aqueous medium under the presence of a dispersant to prepare a dispersion, and heating the dispersion or adding a hardener thereto to harden the dispersion;

(3) a method of preparing an aqueous dispersion of polyaddition or polycondensation resins such as a polyester resin, a polyurethane resin and an epoxy resin by dissolving an emulsifier in a precursor (such as a monomer and an oligomer) or a solution (preferably a liquid or may be liquefied by heat) thereof to prepare a solution, and adding water thereto to subject the solution to a phase-inversion emulsification;

(4) a method of pulverizing a resin prepared by any polymerization methods such as addition condensation, ring scission polymerization, polyaddition and condensation polymerization with a mechanical or a jet pulverizer to prepare a pulverized resin and classifying the pulverized resin to prepare a particulate resin, and dispersing the particulate resin in an aqueous medium under the presence of a dispersant;

(5) a method of spraying a resin solution wherein a resin prepared by any polymerization methods such as addition condensation, ring scission polymerization, polyaddition and condensation polymerization is dissolved in a solvent to prepare a particulate resin, and dispersing the particulate resin in an aqueous medium under the presence of a dispersant;

(6) a method of adding a lean solvent in a resin solution wherein a resin prepared by any polymerization methods such as addition condensation, ring scission polymerization, polyaddition and condensation polymerization is dissolved in a solvent, or cooling a resin solution wherein the resin is dissolved upon application of heat in a solvent to separate out a particulate resin and removing the solvent therefrom, and dispersing the particulate resin in an aqueous medium under the presence of a dispersant;

(7) a method of dispersing a resin solution, wherein a resin prepared by any polymerization methods such as addition condensation, ring scission polymerization, polyaddition and condensation polymerization is dissolved in a solvent, in an aqueous medium under the presence of a dispersant, and removing the solvent upon application of heat or depressure; and (8) a method of dissolving an emulsifier in a resin solution wherein a resin prepared by any polymerization methods such as addition condensation, ring scission polymerization, polyaddition and condensation polymerization is dissolved in a solvent, and adding water thereto to subject the solution to a phase-inversion emulsification.

The toner of the present invention can be prepared by known methods such as a suspension polymerization method, an emulsification agglutination method and an emulsification dispersion method, and a toner prepared by a method of dissolving or dispersing toner constituents comprising a compound including a group having an active hydrogen and a polymer reactable therewith in an organic solvent to prepare a solution, dispersing or emulsifying the solution in an aqueous medium to prepare a dispersion, and removing the organic solvent from the dispersion is preferably used.

The solvent is preferably volatile and has a boiling point lower than 150° C. because of easily removed. Specific examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination. Among these solvents, aromatic solvents such as toluene and xylene; and halogenated hydrocarbons such as methylene chloride, 1,2-dichloroethane, chloroform, and carbon tetrachloride are preferably used. Particularly, the ethyl acetate is more preferably used.

The usage thereof is preferably from 40 to 300 parts by weight, more preferably from 60 to 140, and even more preferably from 80 to 120 parts by weight, per 100 parts by weight of the toner constituents.

The solution or dispersion prepared by dissolving or dispersing the toner constituents in the organic solvent is emulsified or dispersed in the aqueous medium, wherein a reaction between the compound having a group including an active hydrogen and the polymer reactable therewith is performed.

Specific examples of the aqueous medium include water, a water-soluble solvent, a mixture thereof, etc. Particularly, water us preferably used.

Specific examples of the water-soluble solvents include alcohols such as methanol, isopropanol and ethylene glycol; dimethylformamide; tetrahydrofuran; cellosolves; lower ketones such as acetone and methyl ethyl ketone; etc. These can be used alone or in combination.

The dispersion method is not particularly limited, and known mixers and dispersers such as a low shearing-force disperser, a high shearing-force disperser, a friction disperser, a high-pressure jet disperser and an ultrasonic disperser can be used. In order to prepare the toner for use in the present invention, it is preferable to prepare an emulsion including particles having an average particle diameter of from 2 to 20 μm. Therefore, the high shearing-force disperser is preferably used.

When the high shearing-force disperser is used, the rotation speed of rotors thereof is not particularly limited, but the rotation speed is typically from 1,000 to 30,000 rpm, and preferably from 5,000 to 20,000 rpm. In addition, the dispersion time is also not particularly limited, but the dispersion time is typically from 0.1 to 5 minutes. The temperature in the dispersion process is typically 0 to 150° C. (under pressure), and preferably from 40 to 98° C. The processing temperature is preferably as high as possible because the viscosity of the dispersion decreases and thereby the dispersing operation can be easily performed.

An embodiment of the method of preparing a toner by granulating the adhesive base material.

The method includes preparation of the aqueous medium, preparation of the solution or dispersion of the toner constituents, emulsification or dispersion of the solution or dispersion of the toner constituents in the aqueous medium, production of a binder resin formed of the reaction between the compound having a group including an active hydrogen and the polymer reactable therewith, removal of the organic solvent, synthesis of the polymer reactable with the compound having a group including an active hydrogen (prepolymer), synthesis of the compound having a group including an active hydrogen, etc.

The particulate resin is dispersed in the aqueous medium. The aqueous medium preferably includes the particulate resin in an amount of from 0.5 to 10% by weight.

The solution or dispersion of the toner constituents can be prepared by dissolving or dispersing toner constituents such as the compound having a group including an active hydrogen, the polymer reactable therewith, the crystalline resin, the colorant, the release agent, the charge controlling agent, the unmodified polyester resin in the organic solvent. In addition, to form an inorganic oxide-containing layer in 1 μm deep from the surface of the toner, an inorganic oxide such as silica, titania and alumina is included therein.

The toner constituents besides the polymer reactable with the compound having a group including an active hydrogen (prepolymer) may be added the aqueous medium when the particulate resin is dispersed therein or when the solution or dispersion of the toner constituents is added to the aqueous medium.

When the solution or dispersion of the toner constituents is emulsified or dispersed in the aqueous medium, the compound having a group including an active hydrogen and the polymer reactable therewith are subjected to an elongation or crosslinking reaction to produce the adhesive base material.

The adhesive base material such as the urea-modified polyester resin may be produced by (1) emulsifying or dispersing the solution or dispersion of the toner constituents including the polymer reactable with the compound having a group including an active hydrogen such as the prepolymer including an isocyanate group (A) with the compound having a group including an active hydrogen such as the amines (B) in the aqueous medium to be subjected to an elongation or a crosslinking reaction; (2) emulsifying or dispersing the solution or dispersion of the toner constituents in the aqueous medium previously including the compound having a group including an active hydrogen to be subjected to an elongation or a crosslinking reaction; and (3) emulsifying or dispersing the solution or dispersion of the toner constituents in the aqueous medium, and adding the compound having a group including an active hydrogen thereto to be subjected to an elongation or a crosslinking reaction, wherein the modified polyester is preferentially formed on the surface of the toner, which can have a concentration gradient thereof.

The reaction time of the elongation or crosslinking reaction between the compound having a group including an active hydrogen and the polymer reactable therewith is preferably from 10 min to 40 hrs, and more preferably from 2 to 24 hrs. The reaction temperature is preferably from 0 to 150° C., and more preferably from 40 to 98° C.

Methods of stably forming the dispersion including the polymer reactable with the compound having a group including an active hydrogen, such as the polyester prepolymer including an isocyanate group (A) in the aqueous medium include, e.g., a method of adding the solution or dispersion prepared by dissolving or dispersing the polymer reactable with the compound having a group including an active hydrogen such as the polyester prepolymer including an isocyanate group (A), the colorant, the release agent, the charge controlling agent and the unmodified polyester resin in the organic solvent, into the aqueous medium, and dispersing the solution or dispersion therein with a shearing force.

In order to stabilize the dispersion (oil drops of the solution or dispersion of the toner constituents) and sharpen a particle diameter thereof while forming a desired shape thereof, a dispersant is preferably used.

Specific examples of the dispersant include a surfactant, an inorganic dispersant hardly soluble in water, a polymer protective colloid, etc. These can be used alone or in combination, and the surfactant is preferably used.

The surfactants include anionic surfactants, cationic surfactants, nonionic surfactants, ampholytic surfactants, etc.

Specific examples of the anionic surfactants include an alkylbenzene sulfonic acid salt, an α-olefin sulfonic acid salt, a phosphoric acid salt, etc., and anionic surfactants having a fluoroalkyl group are preferably used. Specific examples thereof include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4) sulfonate, sodium 3-{omega-fluoroalkanoyl(C6-C8)-N-ethylamino}-1-propanesulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl (C6-C10)-N-ethylsulfonyl glycin, monoperfluoroalkyl(C6-C16)ethylphosphates, etc. Specific examples of the marketed products of such surfactants include SARFRON S-111, S-112 and S-113, which are manufactured by Asahi Glass Co., Ltd.; FLUORAD FC-93, FC-95, FC-98 and FC-129, which are manufactured by Sumitomo 3M Ltd.; UNIDYNE DS-101 and DS-102, which are manufactured by Daikin Industries, Ltd.; MEGAFACEF-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of the cationic surfactants include amine salts such as an alkyl amine salt, an aminoalcohol fatty acid derivative, a polyamine fatty acid derivative and an imidazoline; and quaternary ammonium salts such as an alkyltrimethyl ammonium salt, a dialkyldimethyl ammonium salt, an alkyldimethyl benzyl ammonium salt, a pyridinium salt, an alkyl isoquinolinium salt and a benzethonium chloride. Among the cationic surfactants, primary, secondary and tertiary aliphatic amines having a fluoroalkyl group, aliphatic quaternary ammonium salts such as perfluoroalkyl(C6-C10) sulfoneamidepropyltrimethylammonium salts, benzalkonium salts, benzetonium chloride, pyridinium salts, imidazolinium salts, etc. are preferably used. Specific examples of the marketed products thereof include SARFRON S-121 (from Asahi Glass Co., Ltd.); FLUORAD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

Specific examples of the nonionic surfactants include a fatty acid amide derivative, a polyhydric alcohol derivative, etc.

Specific examples of the ampholytic surfactants include alanine, dodecyldi(aminoethyl)glycin, di(octylaminoethyle) glycin, and N-alkyl-N, N-dimethylammonium betaine, etc.

Specific examples of the inorganic surfactants hardly soluble in water include tricalcium phosphate, calcium carbonate, colloidal titanium oxide, colloidal silica, and hydroxyapatite. Specific examples of the protective colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g., acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

In addition to the dispersants, a dispersion stabilizer is optionally used. Specific examples thereof include acid and alkali-soluble materials such as calcium phosphate. It is preferable to dissolve the dispersant with hydrochloric acid to remove that from the toner particles, followed by washing. In addition, it is possible to remove such a dispersant by decomposing the dispersant using an enzyme.

In addition, known catalysts such as dibutyltin laurate and dioctyltin laurate can be used for the elongation and crosslinking reaction, if desired.

The organic solvent is removed from the dispersion (emulsified slurry) by (1) a method of gradually heating the dispersion to completely evaporate the organic solvent in the oil drop and (2) a method of spraying the emulsified dispersion in a dry atmosphere to completely evaporate the organic solvent in the oil drop and to evaporate the aqueous dispersant, etc.

When removed, toner particles are formed. The toner particles are washed, dried and further classified if desired. The toner particles are classified by removing fine particles with a cyclone, a decanter, a centrifugal separator, etc. in the dispersion. Alternatively, the toner particles may be classified as a powder after dried.

The thus prepared dry toner particles can be mixed with one or more other particulate materials such as external additives mentioned above, release agents, charge controlling agents, fluidizers and colorants optionally upon application of mechanical impact thereto to fix the particulate materials on the toner particles.

Specific examples of such mechanical impact application methods include methods in which a mixture is mixed with a highly rotated blade and methods in which a mixture is put into a jet air to collide the particles against each other or a collision plate. Specific examples of such mechanical impact applicators include ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), automatic mortars, etc.

The toner preferably has the following volume-average particle diameter (Dv), volume-average particle diameter (Dv)/number-average particle diameter (Dn), average circularity, shape factor SF-1, shape factor SF-2, etc.

The toner preferably has a volume-average particle diameter (Dv) of from 3 to 8 μm, more preferably from 4 to 7 μm, and much more preferably from 5 to 6 μm. The volume-average particle diameter (Dv) is specified as follows:

$$Dv=[(\Sigma(nD^3)/\Sigma n)^{1/3}$$

wherein n represents the number of particles, and D represents a particle diameter.

When less than 3 μm, the toner is fusion-bonded to the surface of a carrier when used in a two-component developer, resulting in deterioration of the chargeability of the carrier, and filming thereof over a developing roller and fusion bond thereof to a blade forming a thin layer thereof tend to occur when used as a one-component developer. When greater than 8 μm, the toner is difficult to produce high definition and high-quality images, and largely varies in the particle diameter when the toner is consumed and fed in the developer.

The toner preferably has a ratio (Dv/Dn) of the volume-average particle diameter. (Dv) to a number-average particle diameter (Dn) not greater than 1.25, more preferably of from 1.00 to 1.20, and much more preferably of from to 1.10 to 1.20.

When the Dv/Dn is not greater than 1.25, the resultant toner has comparatively a sharp particle diameter distribution and the fixability thereof improves. When less than 1.00, the toner is fusion-bonded to the surface of a carrier when used in a two-component developer, resulting in deterioration of the chargeability of the carrier, and filming thereof over a developing roller and fusion bond thereof to a blade forming a thin layer thereof tend to occur when used as a one-component developer. When greater than 1.20, the toner is difficult to produce high definition and high-quality images, and largely varies in the particle diameter when the toner is consumed and fed in the developer.

The (Dv) and the ratio (Dv)/(Dn) can be measured by MULTISIZER II from Beckman Coulter, Inc.

The average circularity is determined by dividing a circumferential length of a circle having an area equivalent to a projected area of the toner with a length of the actual particle, and is preferably from 0.930 to 1.000, and more preferably from 0.940 to 0.99.

When less than 0.930, the toner becomes amorphous and has difficulty in having sufficient transferability and producing high-quality images without a toner dust. When greater than 0.98, an image forming apparatus using blade cleaning has poor cleaning on a photoreceptor and a transfer belt. For example, when images having a large image area such as photo images are produced, untransferred toner occasionally remains on the photoreceptor, resulting in background fouling and contamination of a charging roller.

The average circularity of the toner can be measured by an optical detection method of passing a suspension including a particle through a tabular imaging detector and optically detecting and analyzing the particle image with a CCD camera is suitably used, such as a flow-type particle image analyzer FPIA-2100 from SYSMEX CORPORATION.

The shape factor SF-1 represents a degree of roundness of a toner, and is determined in accordance with the following formula (1):

$$SF\text{-}1=\{(MXLNG)^2/\mathrm{AREA}\}\times(100\pi/4) \quad (1)$$

wherein MXLNG represents an absolute maximum length of a particle and AREA represents a projected area thereof.

SF-1 is preferably from 100 to 180, and more preferably from 105 to 140.

When SF-1 is 100, the toner is spherical. The larger SF-1, the more amorphous. When SF-1 is greater than 180, the toner has a wide charge quantity distribution although the cleanability thereof improves, resulting in deterioration of image quality such as foggy images. Further, due to air resistance, the development and transfer by an electric field becomes unfaithful to a line of electric force and the toner adheres between thin lines, resulting in deterioration of image quality such as nonuniform images.

SF-2 represents the concavity and convexity of the shape of the toner, and is determined in accordance with the following formula (2):

$$SF\text{-}2=\{(PERI)^2/\mathrm{AREA}\}\times(100\pi/4) \quad (2)$$

wherein PERI represents a square of a peripheral length of an image projected on a two-dimensional flat surface; and AREA represents an area of the image.

SF-2 is preferably from 100 to 180, and more preferably from 105 to 140. When SF-2 is 100, the toner has no concavity and convexity on the surface. The larger SF-2, the more noticeable the concavity and convexity thereon.

The shape factors SF-1 and SF-2 can be measured by photographing the toner with a scanning electron microscope (S-800) from Hitachi, Ltd. and analyzing the photographed image of the toner with an image analyzer Luzex III from NIRECO Corp.

When almost a spherical toner has a major axis $r_1$, a minor axis $r_2$, and a thickness $r_3$ wherein $r_1 \geqq r_2 \geqq r_3$, a ratio ($r_2/r_1$) of a minor axis $r_2$ to a major axis $r_1$ is preferably from 0.5 to 1.0, and a ratio ($r_3/r_2$) of a thickness $r_3$ to the minor axis ($r_2$) is preferably from 0.7 to 1.0.

When the ratio ($r_2/r_1$) is less than 0.5, the resultant toner which is away from the shape of a true sphere has high cleanability, but poor dot reproducibility and transferability. When the ratio ($r_3/r_2$) is less than 0.7, the resultant toner which is close to a flat shape does not scatter so much as an amorphous toner, but does not have so high a transferability as a spherical toner does. Particularly when the ratio ($r_3/r_2$) is 1.0, the resultant toner becomes a rotating body having the major axis as a rotating axis, and fluidity thereof improves.

Colors of the toner are not particularly limited, and can be selected from at least one of black, cyan, magenta and yellow.

The developer includes at least the toner, and optionally other components such as a carrier. The developer may be a one-component developer or a two-component developer, however, the two-component developer having a long life is preferably used in high-speed printers in compliance with the recent high information processing speed.

Even the one-component developer or two-component developer has less variation of particle diameter of the toner even after repeatedly used, good and stable developability and produces quality images for long periods without filming over a developing roller and fusion bonding to a member such as a blade forming a thin layer of the toner.

The carrier is not particularly limited, and can be selected in accordance with the purpose, however, preferably includes a core material and a resin layer coating the core material.

Specific examples of the core material include known materials such as Mn—Sr materials and Mn—Mg materials having 50 to 90 emu/g; and highly magnetized materials such as iron powders having not less than 100 emu/g and magnetite having 75 to 120 emu/g for image density. In addition, light magnetized materials such as Cu—Zn materials having 30 to 80 emu/g are preferably used to decrease a stress to a photoreceptor having toner ears for high-quality images. These can be used alone or in combination.

The core material preferably has a volume-average particle diameter of from 10 to 200 μm, and more preferably from 40 to 100 μm. When less than 10 μm, a magnetization per particle is so low that the carrier scatters. When larger than 200 μm, a specific surface area lowers and the toner occasionally scatters, and a solid image of a full-color image occasionally has poor reproducibility.

Specific examples of the resin coating the core material include an amino resin, a polyvinyl resin, a polystyrene resin, a halogenated olefin resin, a polyester resin, a polycarbonate resin, a polyethylene resin, a polyvinyl fluoride resin, a polyvinylidene fluoride resin, a polytrifluoroethylene resin, a polyhexafluoropropylene resin, a vinylidenefluoride-acrylate copolymer, a vinylidenefluoride-vinylfluoride copolymer, a copolymer of tetrafluoroethylene, vinylidenefluoride and other monomers including no fluorine atom, a silicone resin, etc. These can be used alone or in combination.

Specific examples of the amino resins include a urea-formaldehyde resin, a melamine resin, a benzoguanamine resin, a urea resin, a polyamide resins, an epoxy resin, etc. Specific examples of the polyvinyl resins include an acrylic resin, a polymethylmethacrylate resin, a polyacrylonitirile resin, a polyvinyl acetate resin, a polyvinyl alcohol resin, a polyvinyl butyral resin, etc. Specific examples of the polystyrene resins include a polystyrene resin, a styrene-acrylic copolymer, etc. Specific examples of the halogenated olefin resins include a polyvinyl chloride resin, etc. Specific examples of the polyester resins include a polyethyleneterephthalate resin, a polybutyleneterephthalate resin, etc.

An electroconductive powder may optionally be included in resin layer. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control the resistance of the resultant toner.

The resin layer can be formed by preparing a coating liquid including a solvent and, e.g., the silicone resin; uniformly coating the liquid on the surface of the core material by a known coating method; and drying the liquid and burning the surface thereof. The coating method includes dip coating methods, spray coating methods, brush coating method, etc.

Specific examples of the solvent include toluene, xylene, methyl ethyl ketone, methyl isobutyl ketone, cellosolve butyl acetate, etc.

Specific examples of the burning methods include externally heating methods or internally heating methods using fixed electric ovens, fluidized electric ovens, rotary electric ovens, burner ovens, microwaves, etc.

The carrier preferably includes the resin layer in an amount of from 0.01 to 5.0% by weight. When less than 0.01% by weight, a uniform resin layer cannot be formed on the core material. When greater than 5.0% by weight, the resin layer becomes so thick that carrier particles granulate one another and uniform carrier particles cannot be formed.

The content of the carrier in the two-component developer is not particularly limited, can be selected in accordance with the purpose, and is preferably from 90 to 98% by weight, and more preferably from 93 to 97% by weight.

The two-component developer typically includes a toner in an amount of from 1 to 10.0 parts by weight per 100 parts by weight of a carrier.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Toner Preparation Example 1

724 parts of an adduct of bisphenol A with 2 moles of ethyleneoxide, 276 parts isophthalic acid and 2 parts of dibutyltinoxide were mixed and reacted in a reactor vessel including a cooling pipe, a stirrer and a nitrogen inlet pipe for 8 hrs at a normal pressure and 230° C. Further, after the mixture was depressurized by 10 to 15 mm Hg and reacted for 5 hrs, 32 parts of phthalic acid anhydride were added thereto and reacted for 2 hrs at 160° C. Next, the mixture was reacted with 188 parts of isophoronediisocyanate in ethyl acetate for 2 hrs at 80° C. to prepare a prepolymer including isocyanate (1).

Next, 67 parts of the prepolymer (1) and 14 parts of isophoronediamine were mixed for 2 hrs at 50° C. to prepare a urea-modified polyester resin (1) having a weigh-average molecular weight of 64,000. Similarly, 724 parts of an adduct of bisphenol A with 2 moles of ethyleneoxide and 276 parts of terephthalic acid were polycondensated for 8 hrs at a normal pressure and 230° C., and further, after the mixture was depressurized by 10 to 15 mm Hg and reacted for 5 hrs to prepare a unmodified polyester resin (a) having a peak molecular weight of 5,000. 200 parts of the urea-modified polyester (1) and 800 parts of the unmodified polyester resin (a) were dissolved and mixed in 2,000 parts of a mixed solvent formed of ethyl acetate and MEK (1/1) to prepare a toner binder resin (1) ethyl acetate/MEK solution. The toner binder resin (1) ethyl acetate/MEK solution was partially depressurized and dried to isolate the toner binder resin (1) The toner binder resin (1) had a glass transition temperature (Tg) of 62° C. and an acid value of 10.

240 parts of the toner binder resin (1) ethyl acetate/MEK solution, 20 parts of pentaelislitholtetrabehenate having a melting point of 81° C. and a melting viscosity of 25 cps and 10 parts of carbon black were mixed at 12,000 rpm in a beaker by a TK-type homomixer at 60° C. to uniformly dissolve and disperse the mixture to prepare a toner material solution. 706 parts of ion-exchanged water, 294 parts of a slurry including 10% hydroxyapatite Supertite 10 from Nippon Chemical Industrial Co., Ltd. and 0.2 parts of sodium dodecylbenzenesulfonate were uniformly dissolved in a beaker. Then, while the mixture was stirred at 12,000 rpm by a TK-type homomixer at 60° C., the above-mentioned toner material solution was added thereto and the mixture was stirred for 10 min. Next, the mixture was moved into a flask with a stirrer and a thermometer, and heated at 98° C. to partially remove a solvent. Further, the mixture was stirred at 12,000 rpm by a TK-type homomixer at a room temperature to completely remove the solvent. Then, the mixture was filtered, washed, dried and classified by a wind force to prepare a parent toner.

Finally, 100 parts of the mother toner and 0.5 parts of hydrophobic silica were mixed by HENSCHEL mixer to prepare a toner (1).

The toner (1) had an average circularity of 0.948 when measured by the following method.

The circularity of the toner is measured by a flow-type particle image analyzer FPIA-2000 from SYSMEX CORPORATION. A specific measuring method includes adding 0.1 to 0.5 ml of a surfactant, preferably an alkylbenzenesulfonic acid, as a dispersant in 100 to 150 ml of water from which impure solid materials are previously removed; adding 0.1 to 0.5 g of the toner in the mixture; dispersing the mixture including the toner with an ultrasonic disperser for 1 to 3 min to prepare a dispersion liquid having a concentration of from 3,000 to 10,000 pieces/μl; and measuring the toner shape and distribution with the above-mentioned measurer.

Toner Preparation Example 2

850 parts of the urea-modified polyester (1) and 150 parts of the unmodified polyester resin (a) were dissolved and mixed in 2,000 parts of a mixed solvent formed of ethyl acetate and MEK (1/1) to prepare a toner binder resin (2) ethyl acetate/MEK solution. The toner binder resin (2) ethyl acetate/MEK solution was partially depressurized and dried to isolate the toner binder resin (2).

The procedure for preparation of the toner (1) in Toner Preparation Example 1 was repeated to prepare a toner (2) except for changing the toner binder resin (1) to the toner binder resin (2).

The toner (2) had an average circularity of 0.987 when measured by the same method in Toner Preparation Example 1.

Toner Preparation Example 3

343 parts of an adduct of bisphenol A with 2 moles of ethyleneoxide, 166 parts isophthalic acid and 2 parts of dibutyltinoxide were mixed and reacted in a reactor vessel including a cooling pipe, a stirrer and a nitrogen inlet pipe for 8 hrs at a normal pressure and 230° C. Further, after the mixture was depressurized by 10 to 15 mm Hg and reacted for 5 hrs, the mixture was cooled to have 80° C. Next, the mixture was reacted with 14 parts of toluenediisocyanate in toluene for 5 hrs at 110° C., and then a solvent was removed therefrom to prepare a urethane-modified polyester resin having a weigh-average molecular weight of 98,000.

363 parts of an adduct of bisphenol A with 2 moles of ethyleneoxide and 166 parts of isophthalic acid were polycondensated similarly to Toner Preparation Example 1 to prepare an unmodified polyester resin. 350 parts of the urethane-modified polyester and 650 parts of the unmodified polyester resin were dissolved and mixed in toluene, and a solvent was removed from the mixture to prepare a toner binder resin (3).

100 parts of the toner binder resin (3) and 8 parts of carbon black were preliminarily mixed by a HENSCHEL mixer and kneaded by a continuous kneader. Then, the kneaded mixture was pulverized by a jet pulverizer and classified by a wind classifier to prepare a parent toner.

100 parts of the mother toner and 1.0 parts of hydrophobic silica and 0.5 parts of a hydrophobic titanium oxide were mixed by HENSCHEL mixer to prepare a toner (3).

The toner (3) had an average circularity of 0.934 when measured by the same method in Toner Preparation Example 1.

Example 1

The following materials were mixed and dispersed in a ball mill for 12 hrs to prepare an undercoat layer coating liquid:

| | |
|---|---|
| Alkyd resin<br>(Bekkolite M6401-50 from Dainippon Ink &Chemicals, Inc.) | 15 |
| Melamine resin<br>(Super Bekkamin G-821-60 from Dainippon Ink &Chemicals, Inc.) | 10 |
| Methyl ethyl ketone | 150 |
| Titanium oxide powder<br>(Tipaque CR-EL from Ishihara Sangyo Kaisha, Ltd.) | 90 |

The thus prepared undercoat layer coating liquid was coated on a cylindrical aluminium substrate having a diameter of 30 mm by a dip coating method, and the coated liquid was dried at 130° C. for 20 min to form an undercoat layer having a thickness of 3.5 μm on the substrate.

Next, the following materials were mixed and dispersed in a ball mill for 48 hrs to prepare a mixture:

| | |
|---|---|
| Polyvinylbutyral resin (XYHL from Union Carbide Corp.) | 4 |
| Cyclohexanone | 150 |
| Bisazo pigment having the following formula (A): | 10 |

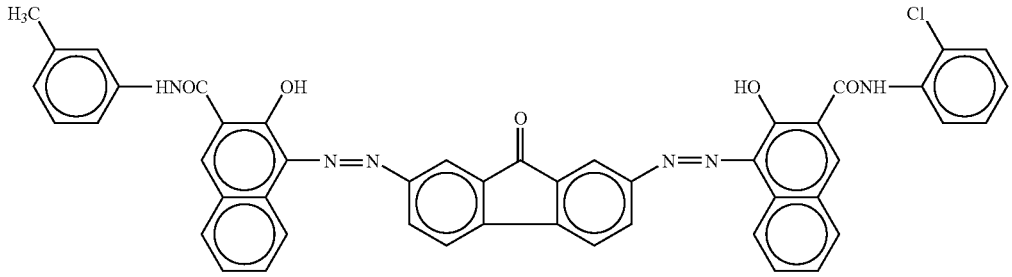

(A)

Further, 210 parts of cyclohexanone were included in the mixture and the mixture was dispersed for 3 hrs. The dispersed mixture was put in a vessel and diluted with cyclohexanone so as to have a solid content of 1.5% by weight. The thus prepared CGL coating liquid was coated on the undercoat layer by a dip coating method, and the coating liquid was dried at 130° C. for 20 min to form a CGL having a thickness of 0.2 μm.

Next, the following materials were mixed to prepare a CTL coating liquid:

| | |
|---|---|
| Tetrahydrofuran | 100 |
| Bisphenol Z-type polycarbonate resin | 10 |
| Silicone oil (KF-50 from Shin-Etsu Chemical Co., Ltd.) | 0.002 |
| Charge transport material having the following formula (B) | 7 |

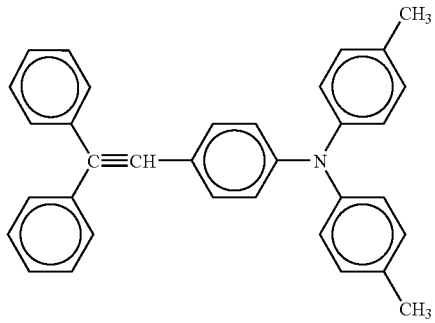

(B)

The thus prepared CTL coating liquid was coated on the CGL by a dip coating method, and the liquid was dried at 110° C. for 20 min to form a CTL having a thickness of 25 μm.

Next, the following materials were mixed to prepare a urethane resin liquid 1.

| | |
|---|---|
| Polyol styrene-acrylic copolymer LZR-170 formed of styrene, methylmethacrylate and hydroxyethylmethacrylate, having an OH equivalent about 367 and a solid content of 41% by weight from FUJIKURA KASEI CO., LTD. | 60 |

-continued

| | |
|---|---|
| Polyisocyanate Sumidule HT from Sumitomo Bayer Urethane Co., Ltd., having a solid content of 75% by weight | 20 |
| Cyclohexanone | 120 |
| Tetrahydrofuran | 400 |

Separately, 8 parts of methyltrimethoxysilane were placed in a flask and cooled at approx. 0° C. with iced water, and 3 parts of a 1 wt % solution of acetate were dropped therein for 1 hr. Then, the mixture was heated for 6 hrs while stirred to have a temperature of 25° C. to prepare a solution of an organic silicon compound solution having a silanol group. The solution of an organic silicon compound solution was mixed with the urethane resin liquid 1, and further 0.5 parts of tris(2,4-pentanedionate)aluminum (III) and 0.15 parts of acetylacetone were added thereto to prepare a protective layer coating liquid.

The protective layer coating liquid was coated on the CTL, and the cylindrical aluminum substrate was left for 10 min while rotated until it becomes dry to touch. Then, the cylindrical aluminum substrate was heated at 150° C. for 30 min to form a protective layer 1 μm thick thereon. Thus, an electrostatic latent image bearer was prepared.

Example 2

The procedure for preparation of the electrostatic latent image bearer in Example 1 was repeated to prepare an electrostatic latent image bearer except for replacing 8 parts of the methyltrimethoxysilane in the protective layer coating liquid with 3 parts thereof and 4 parts phenyltrimethoxysilane.

Example 3

The procedure for preparation of the electrostatic latent image bearer in Example 1 was repeated to prepare an electrostatic latent image bearer except for replacing the solution of an organic silicon compound solution with 4 parts of a hardening polysiloxane resin [NSC1275 for silicone hard coating, having a solid content of 20% by weight from NIPPON FINE CHEMICAL CO., LTD.] and excluding the tris (2,4-pentanedionate)aluminum (III) and the acetylacetone in the protective layer coating liquid.

Example 4

The procedure for preparation of the electrostatic latent image bearer in Example 3 was repeated to prepare an electrostatic latent image bearer except for replacing 4 parts of the hardening polysiloxane resin with 10 parts thereof.

Example 5

The procedure for preparation of the electrostatic latent image bearer in Example 3 was repeated to prepare an electrostatic latent image bearer except for replacing 4 parts of the hardening polysiloxane resin with 20 parts thereof.

Example 6

The procedure for preparation of the electrostatic latent image bearer in Example 3 was repeated to prepare an electrostatic latent image bearer except for replacing 4 parts of the hardening polysiloxane resin with 80 parts thereof.

Example 7

The procedure for preparation of the electrostatic latent image bearer in Example 3 was repeated to prepare an electrostatic latent image bearer except for replacing 4 parts of the hardening polysiloxane resin with 160 parts thereof.

Example 8

The procedure for preparation of the electrostatic latent image bearer in Example 3 was repeated to prepare an electrostatic latent image bearer except for replacing 4 parts of the hardening polysiloxane resin with 240 parts thereof.

Comparative Example 1

The procedure for preparation of the electrostatic latent image bearer in Example 1 was repeated to prepare an electrostatic latent image bearer except for excluding the solution of an organic silicon compound solution including methyltrimethoxysilane, tris(2,4-pentanedionate)aluminum (III) and the acetylacetone in the protective layer coating liquid.

Comparative Example 2

The procedure for preparation of the electrostatic latent image bearer in Example 1 was repeated to prepare an electrostatic latent image bearer except for excluding the polyol and polyisocyanate in the protective layer coating liquid.

Comparative Example 3

The procedure for preparation of the electrostatic latent image bearer in Example 2 was repeated to prepare an electrostatic latent image bearer except for excluding the polyol and polyisocyanate in the protective layer coating liquid.

Comparative Example 4

The procedure for preparation of the electrostatic latent image bearer in Example 3 was repeated to prepare an electrostatic latent image bearer except for excluding the polyol and polyisocyanate in the protective layer coating liquid.

The adhesiveness of the protective layer to the CTL of each of the electrostatic latent image bearers, and the coating quality and image quality thereof were evaluated as follows. The results are shown in Table 1.

The adhesiveness of the protective layer was evaluated using SAICAS DN-20 from DAIPLA WINTES Co., Ltd.

A 10 mm by 10 mm piece of each surface of the electrostatic latent image bearers was cut therefrom and set on the SAICAS DN-20.

Figure 12:
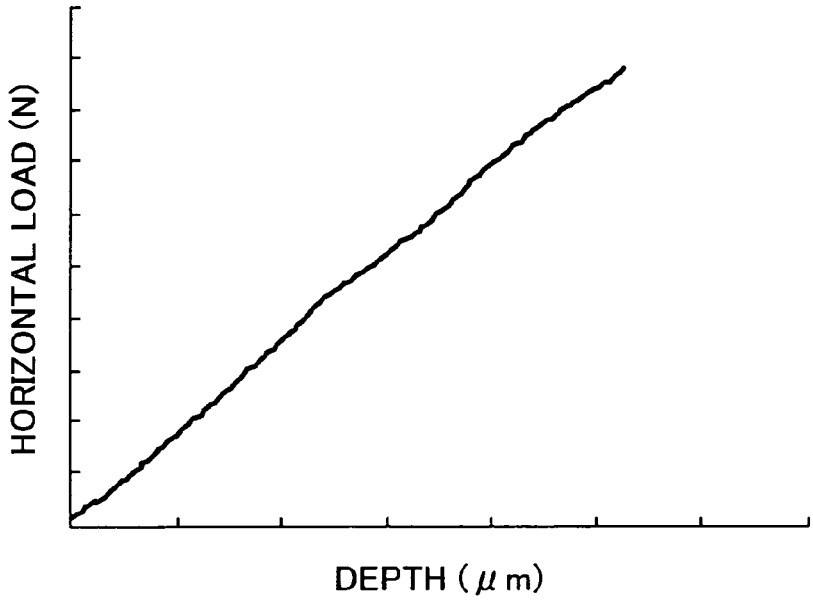
FIG. 12 is a graph showing the relationship between the cutting hour (depth) and the horizontal load in adhesiveness test of the protective layer with a SAICAS apparatus for use in the present invention layer when the protective layer does not peel.
Figure 13:
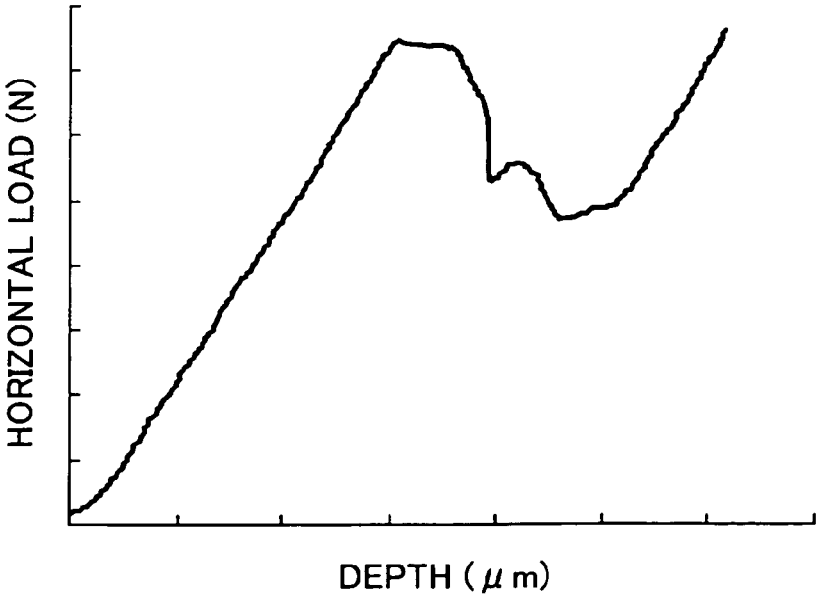
FIG. 13 is a graph showing the relationship between the cutting hour (depth) and the horizontal load in adhesiveness test of the protective layer with a SAICAS apparatus for use in the present invention layer when the protective layer peels.

As shown in FIG. 12, a horizontal load per cutting time (depth) of a uniform coating is almost a straight line in a graph, but a peeled coating has line with a inflection point at a depth where the peeling occurs in a graph as shown in FIG. 13.

Each surface of the electrostatic latent image bearers was visually observed to see coating defects and clouds.

After a charger voltage is adjusted such that a potential of a non-irradiated part of the electrophotographic photoreceptor (VD) was −600 V, the image quality of a letter having a font size of 2 points (about 0.5 mm×0.5 mm) was evaluated ○: good Δ: slightly distorted, but practicable ×: considerably distorted and impracticable

TABLE 1

| | Adhesiveness | Coating quality | Image quality |
|---|---|---|---|
| Example 1 | No inflection point | A small hole | Δ |
| Example 2 | No inflection point | A small hole | Δ |
| Example 3 | A small inflection point | Good | Δ |
| Example 4 | No inflection point | Good | Δ |
| Example 5 | No inflection point | Good | Δ |
| Example 6 | No inflection point | Good | Δ |
| Example 7 | No inflection point | Good | Δ |
| Example 8 | No inflection point | Good | Δ |
| Comparative Example 1 | A large inflection point at 0.5 μm depth | Good | Δ |
| Comparative Example 2 | No inflection point | A hole and clouded | X |
| Comparative Example 3 | No inflection point | Clouded | X |
| Comparative Example 4 | No inflection point | Clouded | X |

The electrostatic latent image bearers in Examples 1 to 8, having protective layers including the binder resin of the present invention, have high adhesiveness of the protective layers, good coating quality and produce images without practical problem. The electrostatic latent image bearers in Comparative Examples 1 to 4 without the polyol, polyisocyanate and organic silicon compound had peeling of the protective layer in Comparative Example 1, and poor coating quality, resulting in very poor image quality in Comparative Examples 2 to 4.

Example 9

The procedure for preparation of the electrostatic latent image bearer in Example 1 was repeated to prepare an electrostatic latent image bearer except for forming a protective layer having the following formulation.

The following materials were mixed to prepare a urethane resin liquid 2.

| | |
|---|---|
| Polyol | 57 |
| Acrylic polyol resin Acryldic A-801-P, having an OH value of 100, an OH equivalent about 561 and a solid content of 50% by weight from Dainippon Ink And Chemicals, Incorporated | |
| Polyisocyanate | 14 |
| Sumidule HT from Sumitomo Bayer Urethane Co., Ltd., having a solid content of 75% by weight | |
| Cyclohexanone | 120 |
| Tetrahydrofuran | 400 |

Next, 20 parts a hardening polysiloxane resin [NSC1275 for silicone hard coating, having a solid content of 20% by weight from NIPPON FINE CHEMICAL CO.], were added to the urethane resin liquid 2 to prepare a coating liquid.

The protective layer coating liquid was coated on the CTL, and the cylindrical aluminum substrate was left for 10 min while rotated until it becomes dry to touch. Then, the cylindrical aluminum substrate was heated at 150° C. for 30 min to form a protective layer 1 μm thick thereon. Thus, an electrostatic latent image bearer was prepared.

Example 10

The procedure for preparation of the electrostatic latent image bearer in Example 9 was repeated to prepare an electrostatic latent image bearer except for replacing the polyol with 70 parts of an acrylic polyol resin [Acryldic 45-116, having an OH value of 40, an OH equivalent about 1,400 and a solid content of 50% by weight from Dainippon Ink And Chemicals, Incorporated, and 14 parts of the polyisocyanate with 7 parts thereof in the protective layer coating liquid.

Example 11

The procedure for preparation of the electrostatic latent image bearer in Example 9 was repeated to prepare an electrostatic latent image bearer except for replacing the polyol with 70 parts of an acrylic resin for urethane [HITALOID H3001, having an OH value of 40, an OH equivalent about 1,870 and a solid content of 50% by weight from Dainippon Ink And Chemicals, Incorporated, and 14 parts of the polyisocyanate with 5.5 parts thereof in the protective layer coating liquid.

Example 12

The procedure for preparation of the electrostatic latent image bearer in Example 9 was repeated to prepare an electrostatic latent image bearer except for replacing the polyol with 14 parts of a styrene-acrylic copolymer LZR-170 formed of styrene, methylmethacrylate and hydroxyethylmethacrylate, having an OH equivalent about 367 and a solid content of 41% by weight from FUJIKURA KASEI CO., LTD., adding 5 parts of trimethylolpropane having an OH equivalent about 45, and replacing 14 parts of the polyisocyanate with 38 parts thereof in the protective layer coating liquid.

Example 13

The procedure for preparation of the electrostatic latent image bearer in Example 9 was repeated to prepare an electrostatic latent image bearer except for replacing 70 parts of the an acrylic resin for urethane with 11 parts thereof, adding 5.5 parts of trimethylolpropane having an OH equivalent about 45, and replacing 14 parts of the polyisocyanate with 37.5 parts thereof in the protective layer coating liquid.

Example 14

The procedure for preparation of the electrostatic latent image bearer in Example 10 was repeated to prepare an electrostatic latent image bearer except for replacing 70 parts of an acrylic polyol resin with 11 parts thereof, adding 5.5 parts of trimethylolpropane having an OH equivalent about 45, and replacing 14 parts of the polyisocyanate with 37 parts thereof in the protective layer coating liquid.

Example 15

The procedure for preparation of the electrostatic latent image bearer in Example 11 was repeated to prepare an electrostatic latent image bearer except for replacing 70 parts of an acrylic resin for urethane with 11 parts thereof, adding 5.7 parts of trimethylolpropane having an OH equivalent about 45, and replacing 14 parts of the polyisocyanate with 37 parts thereof in the protective layer coating liquid.

Example 16

The procedure for preparation of the electrostatic latent image bearer in Example 12 was repeated to prepare an electrostatic latent image bearer except for replacing 14 parts of a styrene-acrylic copolymer with 44 parts thereof, 5 parts of trimethylolpropane with 2 parts thereof, and 38 parts of the polyisocyanate with 26 parts thereof in the protective layer coating liquid.

Example 17

The procedure for preparation of the electrostatic latent image bearer in Example 12 was repeated to prepare an electrostatic latent image bearer except for replacing 14 parts of a styrene-acrylic copolymer with 1.8 parts thereof, 5 parts of trimethylolpropane with 6.5 parts thereof, and 38 parts of the polyisocyanate with 42 parts thereof in the protective layer coating liquid.

Example 18

The procedure for preparation of the electrostatic latent image bearer in Example 12 was repeated to prepare an electrostatic latent image bearer except for replacing 20 parts of the hardening polysiloxane resin with 10 parts thereof.

Example 19

The procedure for preparation of the electrostatic latent image bearer in Example 12 was repeated to prepare an electrostatic latent image bearer except for replacing 20 parts of the hardening polysiloxane resin with 80 parts thereof.

Example 20

The procedure for preparation of the electrostatic latent image bearer in Example 12 was repeated to prepare an electrostatic latent image bearer except for replacing 20 parts of the hardening polysiloxane resin with 160 parts thereof.

Comparative Examples 5 to 11

The procedures for preparation of the electrostatic latent image bearers in Examples 9 to 15 were repeated to prepare electrostatic latent image bearers except for excluding the hardening polysiloxane resins respectively.

The durabilities of the electrostatic latent image bearers prepared in Examples 9 to 20, Comparative Examples 5 to 11, and Example 5 and Comparative Example 1 were evaluated as follows. The results are shown in Table 2.

Each of the electrostatic latent image bearers and the toner (1) were installed in IPSiO CX8200 from Ricoh Company, Ltd., which was modified such that (1) the contact pressure of the cleaning blade to the photoreceptor doubled and (2) a bar formed of melt-solidified zinc stearate was pressurized to the cleaning brush with a spring and coated on the surface of the photoreceptor through the cleaning brush.

After a charger voltage is adjusted such that a potential of a non-irradiated part of the electrophotographic photoreceptor (VD) was −700 V, 50,000 images having an A4 size and a 1,200 dpi image area ratio of 5% were produced with a laser irradiation having a wavelength of 660 nm. From a difference between thickness of a photosensitive layer of the electrophotographic photoreceptor before and after 20,000 images were produced, an abrasion amount thereof was determined. The thickness was measured by an eddy-current thickness meter Fischer Scope MMS from Fischer AG. When a parts of the protective layer was peeled, the abrasion amount of an unpeeled part thereof was measured.

The peeling of the protective layer was visually observed.

No: Not peeled until 20,000 images were produced

A: Peeled area increased as images were produced more

B: Totally peeled

After a charger voltage is adjusted such that a potential of a non-irradiated part of the electrophotographic photoreceptor (VD) was −600 V, the image qualities of a letter having a font size of 2 points (about 0.5 mm×0.5 mm) and a 600 dpi overall halftone image were evaluated.

○: good

Δ: slightly distorted, but practicable

×: considerably distorted and impracticable

TABLE 2

| | Abraded quantity (μm) | Peeling | Image quality |
|---|---|---|---|
| Example 5 | 0.6 | No | Δ |
| Example 9 | 0.6 | No | Δ |
| Example 10 | 0.8 | No | Δ |
| Example 11 | 0.9 | No | Δ |
| Example 12 | 0.2 | No | Δ |
| Example 13 | 0.3 | No | Δ |
| Example 14 | 0.5 | No | Δ |
| Example 15 | 0.6 | No | Δ |
| Example 16 | 0.6 | No | Δ |
| Example 17 | 0.2 | No | Δ |
| Example 18 | 0.3 | No | Δ |

TABLE 2-continued

| | Abraded quantity (μm) | Peeling | Image quality |
|---|---|---|---|
| Example 19 | 0.2 | No | Δ |
| Example 20 | 0.2 | No | Δ |
| Comparative Example 1 | 0.7 | A | X (uneven image density at peeled and unpeeled parts) |
| Comparative Example 5 | 0.6 | A | X (uneven image density at peeled and unpeeled parts) |
| Comparative Example 6 | 0.8 | A | X (uneven image density at peeled and unpeeled parts) |
| Comparative Example 7 | 0.9 | A | X (uneven image density at peeled and unpeeled parts) |
| Comparative Example 8 | — | B | Unevaluatable |
| Comparative Example 9 | — | B | Unevaluatable |
| Comparative Example 10 | — | B | Unevaluatable |
| Comparative Example 11 | 0.6 | A | X (uneven image density at peeled and unpeeled parts) |

The electrostatic latent image bearers in Examples 5 and 9 to 20, having protective layers including the binder resin of the present invention, have very high abrasion resistance and adhesiveness of the protective layers, produce images without practical problem even after the durability test. Meanwhile any one of the electrostatic latent image bearers in Comparative Examples 1 and 5 to 11 without the polyol, polyisocyanate and organic silicon compound had peeling of the protective layer in Comparative Example 1, and poor coating quality, resulting in very poor image quality.

Example 21

The procedure for preparation of the electrostatic latent image bearer in Example 1 was repeated to prepare an electrostatic latent image bearer except for forming a protective layer having the following formulation.

The following materials were mixed to prepare a zinc antimonate dispersion 1.

| | |
|---|---|
| Zinc antimonate sol<br>Celnax CX-Z210 having a solid content of 20% by weight from NISSAN CHEMICAL INDUSTRIES, LTD. | 11 |
| cyclohexanone | 120 |
| Tetrahydrofuran | 400 |

The following materials were further mixed with the to zinc antimonate dispersion 1 to prepare a protective layer coating liquid.

| | |
|---|---|
| Polyol<br>styrene-acrylic copolymer LZR-170 formed of styrene, methylmethacrylate and hydroxyethylmethacrylate, having an OH equivalent about 367 and a solid content of 41% by weight from FUJIKURA KASEI CO., LTD. | 14 |

-continued

| | |
|---|---|
| Trimethylolpropane having an OH equivalent about 45 | 5 |
| Polyisocyanate Sumidule HT from Sumitomo Bayer Urethane Co., Ltd., having a solid content of 75% by weight | 38 |
| Hardening polysiloxane resin NSC1275 for silicone hard coating having a solid content of 20% by weight from NIPPON FINE CHEMICAL CO. | 20 |

The protective layer coating liquid was coated on the CTL, and the cylindrical aluminum substrate was left for 10 min while rotated until it becomes dry to touch. Then, the cylindrical aluminum substrate was heated at 150° C. for 30 min to form a protective layer 2 μm thick thereon. Thus, an electrostatic latent image bearer was prepared.

The volume-average particle diameter of the zinc antimonate sol in the protective layer was 0.04 μm when measured by FPAR-1000 from Otsuka Electronics Co., Ltd.

Example 22

The procedure for preparation of the electrostatic latent image bearer in Example 21 was repeated to prepare an electrostatic latent image bearer except for replacing 11 parts of the zinc antimonate sol with 24 parts thereof in the protective layer coating liquid, and forming a protective layer 3 μm thick.

The volume-average particle diameter of the zinc antimonate sol in the protective layer was 0.07 μm when measured by FPAR-1000 from Otsuka Electronics Co., Ltd.

Example 23

The procedure for preparation of the electrostatic latent image bearer in Example 21 was repeated to prepare an electrostatic latent image bearer except for replacing 11 parts of the zinc antimonate sol with 70 parts thereof in the protective layer coating liquid, and forming a protective layer 5 μm thick.

The volume-average particle diameter of the zinc antimonate sol in the protective layer was 0.2 μm when measured by FPAR-1000 from Otsuka Electronics Co., Ltd.

Example 24

The procedure for preparation of the electrostatic latent image bearer in Example 21 was repeated to prepare an electrostatic latent image bearer except for replacing 11 parts of the zinc antimonate sol with 140 parts thereof in the protective layer coating liquid, and forming a protective layer 7 μm thick.

The volume-average particle diameter of the zinc antimonate sol in the protective layer was 0.5 μm when measured by FPAR-1000 from Otsuka Electronics Co., Ltd.

Example 25

The procedure for preparation of the electrostatic latent image bearer in Example 21 was repeated to prepare an electrostatic latent image bearer except for replacing 11 parts of the zinc antimonate sol with 300 parts thereof in the protective layer coating liquid, and forming a protective layer 10 μm thick.

The volume-average particle diameter of the zinc antimonate sol in the protective layer was 0.7 μm when measured by FPAR-1000 from Otsuka Electronics Co., Ltd.

Example 26

The procedure for preparation of the electrostatic latent image bearer in Example 24 was repeated to prepare an electrostatic latent image bearer except for replacing 11 parts of the zinc antimonate sol with 45 parts of a zinc antimonate sol CX-Z610 having a solid content of 60% by weight from NISSAN CHEMICAL INDUSTRIES, LTD. in the protective layer coating liquid.

The volume-average particle diameter of the zinc antimonate sol in the protective layer was 0.5 μm when measured by FPAR-1000 from Otsuka Electronics Co., Ltd.

Example 27

The procedure for preparation of the electrostatic latent image bearer in Example 24 was repeated to prepare an electrostatic latent image bearer except for further adding 50 parts of colloidal silica (organosilica sol MEK-ST from Hitachi Chemical Co., Ltd., having a solid content of 50% by weight) to the protective layer coating liquid, and forming a protective layer 5 μm thick.

Example 28

The procedure for preparation of the electrostatic latent image bearer in Example 24 was repeated to prepare an electrostatic latent image bearer except for further adding 15 parts of particulate alumina (SUMICORUNDUM AA-03 from Sumitomo Chemical Co., Ltd.) to the protective layer coating liquid, and applying an ultrasound thereto for 30 min to form a protective layer 5 μm thick.

Example 29

The procedure for preparation of the electrostatic latent image bearer in Example 24 was repeated to prepare an electrostatic latent image bearer except for further adding 15 parts of rutile particulate titanium oxide (TIPAQUE CR-EL from ISHIHARA SANGYO KAISHA, LTD.) to the protective layer coating liquid, and applying an ultrasound thereto for 30 min to form a protective layer 5 μm thick.

Example 30

The procedure for preparation of the electrostatic latent image bearer in Example 24 was repeated to prepare an electrostatic latent image bearer except for further adding 15 parts of 5 parts of particulate tin oxide (SR-1 from Mitsubishi Materials Corporation) to the protective layer coating liquid, and applying an ultrasound thereto for 30 min to form a protective layer 5 μm thick.

Example 31

The procedure for preparation of the electrostatic latent image bearer in Example 1 was repeated to prepare an electrostatic latent image bearer except for forming a protective layer having the following formulation.

The following materials were mixed to prepare a zinc antimonate dispersion 2.

| | |
|---|---|
| Zinc antimonate sol | 24 |
| Celnax CX-Z210 having a solid content of 20% by weight from NISSAN CHEMICAL INDUSTRIES, LTD. | |
| cyclohexanone | 120 |
| Tetrahydrofuran | 400 |

The following materials were further mixed with the to zinc antimonate dispersion 2 to prepare a protective layer coating liquid.

| | |
|---|---|
| Polyol<br>styrene-acrylic copolymer LZR-170 formed of styrene, methylmethacrylate and hydroxyethylmethacrylate, having an OH equivalent about 367 and a solid content of 41% by weight from FUJIKURA KASEI CO., LTD. | 8 |
| Trimethylolpropane<br>having an OH equivalent about 45 | 3 |
| Polyisocyanate<br>Sumidule HT from Sumitomo Bayer Urethane Co., Ltd., having a solid content of 75% by weight | 17 |
| Charge transport material<br>having the formula (B) | 16 |
| Hardening polysiloxane resin<br>NSC1275 for silicone hard coating having a solid content of 20% by weight from NIPPON FINE CHEMICAL CO. | 16 |

The protective layer coating liquid was coated on the CTL, and the cylindrical aluminum substrate was left for 10 min while rotated until it becomes dry to touch. Then, the cylindrical aluminum substrate was heated at 150° C. for 30 min to form a protective layer 5 μm thick thereon. Thus, an electrostatic latent image bearer was prepared.

Example 32

The procedure for preparation of the electrostatic latent image bearer in Example 31 was repeated to prepare an electrostatic latent image bearer except for forming a protective layer having the following formulation.

The following materials were further mixed with the to zinc antimonate dispersion 2 to prepare a protective layer coating liquid.

| | |
|---|---|
| Polyol<br>styrene-acrylic copolymer LZR-170 formed of styrene, methylmethacrylate and hydroxyethylmethacrylate, having an OH equivalent about 367 and a solid content of 41% by weight from FUJIKURA KASEI CO., LTD. | 3 |
| Trimethylolpropane<br>having an OH equivalent about 45 | 1.2 |
| Polyisocyanate<br>Sumidule HT from Sumitomo Bayer Urethane Co., Ltd., having a solid content of 75% by weight | 28 |

-continued

| | |
|---|---|
| Charge transport material<br>having the following formula (C) | 16 |

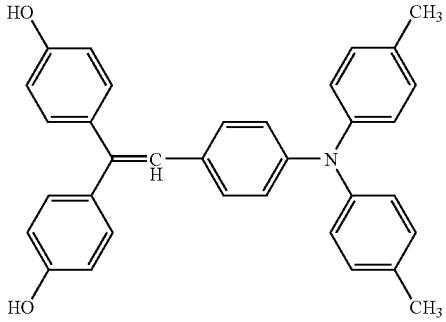

(C)

| | |
|---|---|
| Hardening polysiloxane resin<br>NSC1275 for silicone hard coating having a solid content of 20% by weight from NIPPON FINE CHEMICAL CO. | 20 |

The protective layer coating liquid was coated on the CTL, and the cylindrical aluminum substrate was left for 10 min while rotated until it becomes dry to touch. Then, the cylindrical aluminum substrate was heated at 150° C. for 30 min to form a protective layer 5 μm thick thereon. Thus, an electrostatic latent image bearer was prepared.

Example 33

The procedure for preparation of the electrostatic latent image bearer in Example 31 was repeated to prepare an electrostatic latent image bearer except for forming a protective layer having the following formulation.

The following materials were further mixed with the to zinc antimonate dispersion 2 to prepare a protective layer coating liquid.

| | |
|---|---|
| Polyol<br>styrene-acrylic copolymer LZR-170 formed of styrene, methylmethacrylate and hydroxyethylmethacrylate, having an OH equivalent about 367 and a solid content of 41% by weight from FUJIKURA KASEI CO., LTD. | 4 |
| Trimethylolpropane<br>having an OH equivalent about 45 | 1.6 |
| Polyisocyanate<br>Sumidule HT from Sumitomo Bayer Urethane Co., Ltd., having a solid content of 75% by weight | 26 |
| Charge transport material<br>having the following formula (D) | 6.5 |

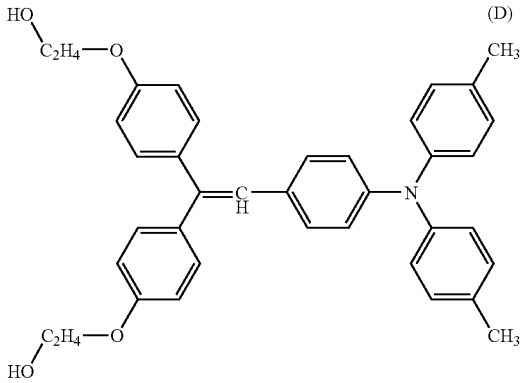

(D)

-continued

| | |
|---|---|
| Hardening polysiloxane resin<br>NSC1275 for silicone hard coating<br>having a solid content of 20% by weight<br>from NIPPON FINE CHEMICAL CO. | 20 |

The protective layer coating liquid was coated on the CTL, and the cylindrical aluminum substrate was left for 10 min while rotated until it becomes dry to touch. Then, the cylindrical aluminum substrate was heated at 150° C. for 30 min to form a protective layer 5 μm thick thereon. Thus, an electrostatic latent image bearer was prepared.

Example 34

The procedure for preparation of the electrostatic latent image bearer in Example 32 was repeated to prepare an electrostatic latent image bearer except for further mixing the following materials with the to zinc antimonate dispersion 2 to prepare a protective layer coating liquid.

| | |
|---|---|
| Polyol<br>styrene-acrylic copolymer LZR-170<br>formed of styrene, methylmethacrylate<br>and hydroxyethylmethacrylate, having<br>an OH equivalent about 367 and a solid<br>content of 41% by weight from<br>FUJIKURA KASEI CO., LTD. | 8 |
| Trimethylolpropane<br>having an OH equivalent about 45 | 3 |
| Polyisocyanate<br>Sumidule HT from Sumitomo Bayer Urethane Co., Ltd.,<br>having a solid content of 75% by weight | 34.5 |
| Charge transport material<br>having the following formula (C) | 10 |

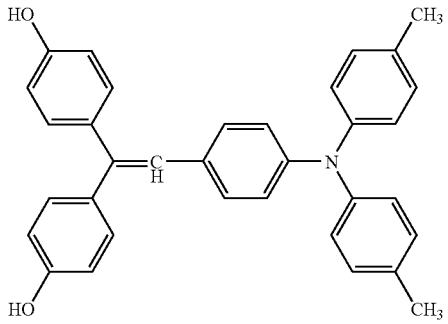

(C)

| | |
|---|---|
| Hardening polysiloxane resin<br>NSC1275 for silicone hard coating<br>having a solid content of 20% by weight<br>from NIPPON FINE CHEMICAL CO. | 20 |

Example 35

The procedure for preparation of the electrostatic latent image bearer in Example 32 was repeated to prepare an electrostatic latent image bearer except for further mixing the following materials with the to zinc antimonate dispersion 2 to prepare a protective layer coating liquid.

| | |
|---|---|
| Polyol<br>styrene-acrylic copolymer LZR-170<br>formed of styrene, methylmethacrylate<br>and hydroxyethylmethacrylate, having<br>an OH equivalent about 367 and a solid<br>content of 41% by weight from<br>FUJIKURA KASEI CO., LTD. | 8.5 |
| Trimethylolpropane<br>having an OH equivalent about 45 | 3 |
| Polyisocyanate<br>Sumidule HT from Sumitomo Bayer Urethane Co., Ltd.,<br>having a solid content of 75% by weight | 26 |
| Charge transport material<br>having the following formula (C) | 13 |

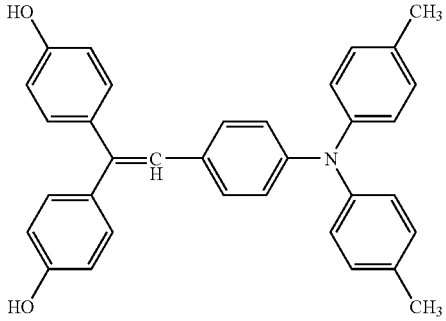

(C)

| | |
|---|---|
| Hardening polysiloxane resin<br>NSC1275 for silicone hard coating<br>having a solid content of 20% by weight<br>from NIPPON FINE CHEMICAL CO. | 20 |

Example 36

The procedure for preparation of the electrostatic latent image bearer in Example 32 was repeated to prepare an electrostatic latent image bearer except for further mixing the following materials with the to zinc antimonate dispersion 2 to prepare a protective layer coating liquid.

| | |
|---|---|
| Polyol<br>styrene-acrylic copolymer LZR-170<br>formed of styrene, methylmethacrylate<br>and hydroxyethylmethacrylate, having<br>an OH equivalent about 367 and a solid<br>content of 41% by weight from<br>FUJIKURA KASEI CO., LTD. | 8 |
| Trimethylolpropane<br>having an OH equivalent about 45 | 3 |
| Polyisocyanate<br>Sumidule HT from Sumitomo Bayer Urethane Co., Ltd.,<br>having a solid content of 75% by weight | 23 |

-continued

| | |
|---|---|
| Charge transport material having the following formula (C) | 8 |

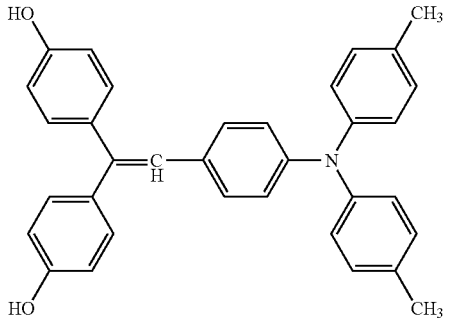

(C)

| | |
|---|---|
| Charge transport material having the following formula (E) | 8 |

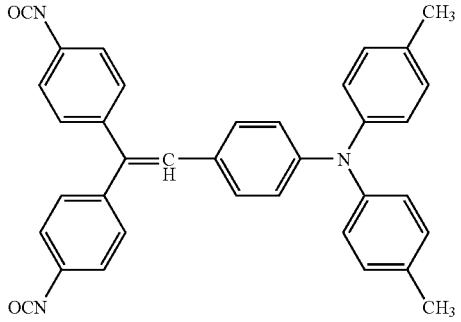

(E)

| | |
|---|---|
| Hardening polysiloxane resin NSC1275 for silicone hard coating having a solid content of 20% by weight from NIPPON FINE CHEMICAL CO. | 20 |

Example 37

The procedure for preparation of the electrostatic latent image bearer in Example 32 was repeated to prepare an electrostatic latent image bearer except for forming a protective layer 7 μm thick.

Example 38

The procedure for preparation of the electrostatic latent image bearer in Example 32 was repeated to prepare an electrostatic latent image bearer except for forming a protective layer 10 μm thick.

Example 39

The procedure for preparation of the electrostatic latent image bearer in Example 32 was repeated to prepare an electrostatic latent image bearer except for forming a protective layer 15 μm thick.

Comparative Examples 12 to 15

The procedures for preparation of the electrostatic latent image bearers in Examples 23 and 31 to 33 were repeated to prepare electrostatic latent image bearers except for excluding the hardening polysiloxane resins respectively.

The durabilities of the electrostatic latent image bearers prepared in Examples 21 to 39 and Comparative Examples 12 to 15 were evaluated as follows. The results are shown in Table 3.

Each of the electrostatic latent image bearers and the toner (1) were installed in IPSiO CX8200 from Ricoh Company, Ltd., which was modified such that (1) the contact pressure of the cleaning blade to the photoreceptor doubled and (2) a bar formed of melt-solidified zinc stearate was pressurized to the cleaning brush with a spring and coated on the surface of the photoreceptor through the cleaning brush.

After a charger voltage is adjusted such that a potential of a non-irradiated part of the electrophotographic photoreceptor (VD) was −700 V, 50,000 images having an A4 size and a 1,200 dpi image area ratio of 5% were produced with a laser irradiation having a wavelength of 660 nm. From a difference between thickness of a photosensitive layer of the electrophotographic photoreceptor before and after 20,000 images were produced, an abrasion amount thereof was determined. The thickness was measured by an eddy-current thickness meter Fischer Scope MMS from Fischer AG. When a parts of the protective layer was peeled, the abrasion amount of an unpeeled part thereof was measured.

After a black sold image was produced, the surface potential (VL) of the irradiated part of the electrostatic latent image bearer was measured by a surface potential measurer model 1344 from TREK, INC.

The peeling of the protective layer was visually observed.

No: Not peeled until 20,000 images were produced

A: Peeled area increased as images were produced more

B: Totally peeled

After a charger voltage is adjusted such that a potential of a non-irradiated part of the electrophotographic photoreceptor (VD) was −600 V, the image qualities of a letter having a font size of 2 points (about 0.5 mm×0.5 mm) and a 600 dpi overall halftone image were evaluated.

○: good

Δ: slightly distorted, but practicable

×: considerably distorted and impracticable

TABLE 3

| | Abraded quantity (μm) | Irradiated part potential (−V) | Peeling | Image quality |
|---|---|---|---|---|
| Example 21 | 0.7 | 150 | No | Δ |
| Example 22 | 0.7 | 170 | No | Δ |
| Example 23 | 0.8 | 120 | No | ○ |
| Example 24 | 0.7 | 100 | No | ○ |
| Example 25 | 0.9 | 180 | No | Δ |
| Example 26 | 1.0 | 110 | No | ○ |
| Example 27 | 0.7 | 130 | No | Δ |
| Example 28 | 0.5 | 160 | No | ○ |
| Example 29 | 0.6 | 130 | No | ○ |
| Example 30 | 0.5 | 100 | No | ○ |
| Example 31 | 1.1 | 110 | No | Δ |
| Example 32 | 0.7 | 80 | No | ○ |
| Example 33 | 0.6 | 70 | No | ○ |
| Example 34 | 0.7 | 100 | No | Δ |
| Example 35 | 0.9 | 80 | No | ○ |
| Example 36 | 1.2 | 60 | No | ○ |
| Example 37 | 0.7 | 90 | No | ○ |
| Example 38 | 0.8 | 110 | No | ○ |
| Example 39 | 0.8 | 120 | No | ○ |
| Comparative Example 12 | — | — | B | Unevaluatable |

TABLE 3-continued

| | Abraded quantity (μm) | Irradiated part potential (−V) | Peeling | Image quality |
|---|---|---|---|---|
| Comparative Example 13 | 0.7 | 130 | A | X (uneven image density at peeled and unpeeled parts) |
| Comparative Example 14 | 0.6 | 100 | A | X (uneven image density at peeled and unpeeled parts) |
| Comparative Example 15 | 0.8 | 90 | A | X (uneven image density at peeled and unpeeled parts) |

The electrostatic latent image bearers in Examples 21 to 39, having protective layers including the binder resin of the present invention, have very high abrasion resistance and adhesiveness of the protective layers, produce images without practical problem even after the durability test. Meanwhile any one of the electrostatic latent image bearers in Comparative Examples 12 to 15 without the polyol, polyisocyanate and organic silicon compound had peeling of the protective layer in Comparative Example 1, and poor coating quality, resulting in very poor image quality.

Even when using the toner (2) or toner (3), the evaluation results of the electrostatic latent image bearers prepared in Examples 1 to 39 were also good in the adhesiveness of the protective layer, abraded quantity thereof, image quality and surface potential.

Further, even when using calcium stearate or aluminum stearate in place of the zinc stearate for the bar formed of melt-solidified zinc stearate, or a wax bar formed of melt-solidified carnauba wax, the evaluation results of the electrostatic latent image bearers prepared in Examples 1 to 39 were also good.

This application claims priority and contains subject matter related to Japanese Patent Application No. 2005-205874 filed on Jul. 14, 2005, the entire contents of which are hereby incorporated by reference.

Having now fully described the invention, it will be apparent to one of ordinary skill in the art that many changes and modifications can be made thereto without departing from the spirit and scope of the invention as set forth therein.

The invention claimed is:

1. An electrostatic latent image bearer, comprising:

a substrate;

a photosensitive layer, located overlying the substrate; and a protective layer, located overlying the photosensitive layer, wherein the protective layer comprises a binder resin comprising at least one polyol, at least one polyisocyanate and at least one organic silicon compound having a hydroxyl and/or a hydrolyzable group.

2. The electrostatic latent image bearer of claim 1, wherein the organic silicon compound is a hardening siloxane resin.

3. The electrostatic latent image bearer of claim 1, wherein the binder resin comprises the organic silicon compound in an amount of from 1 to 50% by weight based on total weight.

4. The electrostatic latent image bearer of claim 1, wherein the binder resin comprises plural polyols, and wherein at least one of the polyols has an OH equivalent (molecular weight/the number of hydroxyl groups) not less than 30 and less than 150.

5. The electrostatic latent image bearer of claim 4, wherein the binder resin comprises the polyol(s) having an OH equivalent (molecular weight/the number of hydroxyl groups) not less than 30 and less than 150 in an amount of from 10 to 90% by weight based on total weight of the polyols.

6. The electrostatic latent image bearer of claim 4, wherein at least one of the polyols has an OH equivalent not less than 150 and less than 1,500.

7. The electrostatic latent image bearer of claim 1, wherein the protective layer further comprises an electroconductive particulate material having the following formula:

$$M_xSb_yO_z$$

wherein M represents a metallic element; and x, y and z represent molar ratios for respective elements.

8. The electrostatic latent image bearer of claim 7, wherein the protective layer comprises the electroconductive particulate material in an amount of from 1 to 65% by weight.

9. The electrostatic latent image bearer of claim 7, wherein the electroconductive particulate material is zinc antimonate.

10. The electrostatic latent image bearer of claim 7, wherein the electroconductive particulate material has a volume-average particle diameter of from 0.01 to 1 μm.

11. The electrostatic latent image bearer of claim 7, wherein the protective layer further comprises a particulate material selected from the group consisting of silica, alumina, titanium oxide and tin oxide.

12. The electrostatic latent image bearer of claim 11, wherein the protective layer comprises the electroconductive particulate material in an amount of from 10 to 100% by weight based on total weight of the electroconductive particulate material and the particulate material.

13. The electrostatic latent image bearer of claim 1, wherein the protective layer further comprises a charge transport material.

14. The electrostatic latent image bearer of claim 13, wherein the charge transport material has a functional group reactive with any one of the polyol, the polyisocyanate and the organic silicon compound.

15. The electrostatic latent image bearer of claim 14, wherein a weight ratio (D/R) of the charge transport material (D) to the binder resin (R) is from 1/10 to 15/10.

16. The electrostatic latent image bearer of claim 1, wherein the protective layer has a thickness of from 1 to 15 μm.

17. The electrostatic latent image bearer of claim 1, wherein the polyol, the polyisocyanate and the organic silicon compound having a hydroxyl or a hydrolyzable group are crosslinked.

18. An image forming apparatus, comprising:

the electrostatic latent image bearer according to claim 1;

a charger configured to charge the electrostatic latent image bearer;

an irradiator configured to irradiate the electrostatic latent image bearer to form an electrostatic latent image thereon;

an image developer configured to develop the electrostatic latent image with a toner to form a toner image thereon;

a transferer configured to transfer the toner image onto a recording medium; and a fixer configured to fix the toner image thereon.

19. The image forming apparatus of claim 18, further comprising a cleaner configured to remove a toner remaining on the electrostatic latent image bearer.

20. The image forming apparatus of claim 18, wherein the charger charges the electrostatic latent image bearer with a DC voltage overlapped with an AC voltage while contacting or not contacting thereto.

21. The image forming apparatus of claim 18, wherein the charger is a charging roller charging the electrostatic latent image bearer with a gap therebetween and not contacting thereto while applied with a DC voltage overlapped with an AC voltage.

22. The image forming apparatus of claim 18, further comprising a lubricator configured to apply a lubricant on the surface of the electrostatic latent image bearer.

23. The image forming apparatus of claim 22, wherein the lubricant is a metallic soap.

24. The image forming apparatus of claim 23, wherein the metallic soap is a member selected from the group consisting of zinc stearate, aluminum stearate and calcium stearate.

25. The image forming apparatus of claim 18, wherein the toner comprises a binder resin, a colorant and a release agent.

26. The image forming apparatus of claim 18, wherein the apparatus comprises toner, and wherein the toner is prepared by a method comprising:

dissolving or dispersing toner constituents comprising a compound including a group having an active hydrogen and a polymer reactable therewith in an organic solvent to prepare a solution;

dispersing or emulsifying the solution in an aqueous medium to prepare a dispersion; and removing the organic solvent from the dispersion.

27. The image forming apparatus of claim 18, wherein the toner has an average circularity of from 0.93 to 1.00.

28. The image forming apparatus of claim 19, wherein the toner has plural colors to form a color image when overlapped with each other.

29. The image forming apparatus of claim 18, wherein the electrostatic latent image bearer, the charger, the irradiator, the image developer, the transferer and the fixer are plural.

30. The image forming apparatus of claim 18, further comprising an intermediate transfer configured to transfer the toner image from the electrostatic latent image bearer to the transferer.

31. An image forming method, comprising:

charging the electrostatic latent image bearer according to claim 1;

irradiating the electrostatic latent image bearer to form an electrostatic latent image thereon;

developing the electrostatic latent image with a toner to form a toner image thereon;

transferring the toner image onto a recording medium; and fixing the toner image thereon.

32. A process cartridge, comprising:

the electrostatic latent image bearer according to claim 1; and at least one of an irradiator, an image developer, a transferer and a cleaner.

* * * * *